US009675944B2

(12) United States Patent
Werth

(10) Patent No.: US 9,675,944 B2
(45) Date of Patent: Jun. 13, 2017

(54) RECIPROCATING FLUID AGITATOR

(71) Applicant: Saint-Gobain Performance Plastics Corporation, Solon, OH (US)

(72) Inventor: Albert A. Werth, Ft. Myers, FL (US)

(73) Assignee: SAINT-GOBAIN PERFORMANCE PLASTICS CORPORATION, Solon, OH (US)

( * ) Notice: Subject to any disclaimer, the term of this patent is extended or adjusted under 35 U.S.C. 154(b) by 47 days.

(21) Appl. No.: 14/335,619

(22) Filed: Jul. 18, 2014

(65) Prior Publication Data

US 2015/0023132 A1 Jan. 22, 2015

Related U.S. Application Data

(60) Provisional application No. 61/856,455, filed on Jul. 19, 2013, provisional application No. 61/860,380, filed on Jul. 31, 2013.

(51) Int. Cl.

| | |
|---|---|
| ***B01F 5/06*** | (2006.01) |
| ***B01F 5/10*** | (2006.01) |
| ***B01F 13/08*** | (2006.01) |

(52) U.S. Cl.

CPC ..... *B01F 5/0685* (2013.01); *B01F 5/0689* (2013.01); *B01F 5/108* (2013.01); *B01F 13/0863* (2013.01)

(58) Field of Classification Search

CPC ..... B01F 13/08; B01F 5/0685
USPC ..... 366/273–274; 435/302.1
See application file for complete search history.

(56) References Cited

U.S. PATENT DOCUMENTS

| | | | | |
|---|---|---|---|---|
| 1,001,949 | A | 8/1911 | Hanna | |
| 2,498,393 | A * | 2/1950 | Clewell | B01F 11/0082 366/274 |
| 2,615,692 | A | 10/1952 | Muller | |
| 3,110,481 | A * | 11/1963 | Kivenson | B01F 13/0827 310/90.5 |
| 4,169,681 | A | 10/1979 | Kato | |
| 4,465,377 | A * | 8/1984 | de Bruyne | B01F 13/0818 366/273 |
| 4,477,192 | A | 10/1984 | Bonney | |
| 4,732,487 | A | 3/1988 | Pollard | |
| 4,760,028 | A * | 7/1988 | deBruyne | B01F 13/0827 261/120 |
| 5,052,813 | A | 10/1991 | Latto | |
| 5,100,242 | A | 3/1992 | Latto | |

(Continued)

FOREIGN PATENT DOCUMENTS

| | | | |
|---|---|---|---|
| CN | 101657250 | A | 2/2010 |
| EP | 1015105 | B1 | 10/2003 |
| EP | 1894618 | B1 | 8/2009 |

OTHER PUBLICATIONS

The International Search Report and the Written Opinion received from the International Searching Authority (ISA/KR) for International Application No. PCT/US2014/047272, dated Nov. 3, 2014, 10 pages.

*Primary Examiner* — Abbas Rashid
(74) *Attorney, Agent, or Firm* — Chi S. Kim; Abel Law Group, LLP

(57) ABSTRACT

A fluid mixing assembly comprising a fluid agitating element adapted to reciprocate within a fluid between a first position and a second position. The fluid agitating element having an internally disposed magnetic member adapted to couple with an external drive device.

16 Claims, 30 Drawing Sheets

(56) References Cited

U.S. PATENT DOCUMENTS

| | | | | |
|---|---|---|---|---|
| 5,961,213 | A * | 10/1999 | Tsuyuki | B01F 13/0827 366/273 |
| 5,985,535 | A * | 11/1999 | Urabe | B01F 7/166 366/273 |
| 6,270,249 | B1 | 8/2001 | Besuner et al. | |
| 6,488,270 | B2 | 12/2002 | Whiteis | |
| 6,883,960 | B2 | 4/2005 | Reeder et al. | |
| 7,029,166 | B2 | 4/2006 | Haughton et al. | |
| 7,278,781 | B2 | 10/2007 | Haughton et al. | |
| 2003/0053371 | A1* | 3/2003 | Schoeb | B01F 13/0827 366/273 |
| 2006/0176772 | A1 | 8/2006 | Goodwin et al. | |
| 2008/0008028 | A1* | 1/2008 | Terentiev | B01F 7/162 366/273 |
| 2010/0046323 | A1 | 2/2010 | Tien et al. | |
| 2010/0157725 | A1 | 6/2010 | Terentiev et al. | |
| 2010/0284244 | A1 | 11/2010 | Yaniv et al. | |
| 2011/0293807 | A1 | 12/2011 | Dushine et al. | |

* cited by examiner

RECIPROCATING FLUID AGITATOR

CROSS-REFERENCE TO RELATED APPLICATION(S)

This application claims priority under 35 U.S.C. §119(e) to U.S. Patent Application No. 61/856,455 entitled "RECIPROCATING FLUID AGITATOR," by Albert A. Werth, filed Jul. 19, 2013 and this application claims priority under 35 U.S.C. §119(e) to U.S. Patent Application No. 61/860,380 entitled "RECIPROCATING FLUID AGITATOR," by Albert A. Werth, filed Jul. 31, 2013, which applications are both assigned to the current assignee hereof and incorporated herein by reference in their entirety.

FIELD OF THE DISCLOSURE

The present disclosure relates to a device for agitating fluids, and more particularly to a magnetic reciprocating assembly capable of efficiently mixing fluids in a vessel.

RELATED ART

Mixing of fluidic components within a fluid often requires agitation of those components within the fluid. In this regard, mixing can occur in one of several ways: rotary stirring, erratically moving a stirring element within a fluid, shaking a fluid reservoir containing the fluid, deforming the body of the reservoir, circulating the fluid using a pump, or using any combination thereof.

Known techniques for imparting these mixing actions generally include the use of a shaft which extends from the exterior of the fluid reservoir to the fluid contained therein. Shafts extending through the fluid reservoir often introduce seals and fittings into the wall of the reservoir which may fail or leak during operation. Moreover, these seals and fittings can result in contamination of the fluid and/or the component being mixed therein.

Some techniques have been developed to use a magnetic rotating drive to drive a magnet contained in a vessel and stir the fluid therein. In further techniques, superconducting magnets are utilized to suspend the mixing assembly within the reservoir. These assemblies are expensive and require extremely cold operating conditions.

Therefore, a need exist to develop a new type of mixing assembly which can efficiently mix a fluid.

BRIEF DESCRIPTION OF THE DRAWINGS

Embodiments are illustrated by way of example and are not limited in the accompanying figures.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the fluid mixing art.

Unless otherwise specified, the use of any numbers or ranges when describing a component is approximate and merely illustrative and should not be limited to include only that specific value.

The following description is related to a fluid mixing assembly, and particularly, to a mixing assembly adapted to reciprocate within a fluid. For example, a mixing assembly can include a magnetic member adapted to engage with a drive device such as a rotatable magnetic drive or an electromagnetic drive such that rotation of the rotatable drive device or periodic energization of the electromagnetic drive can cause reciprocation of the mixing assembly and pumping of the fluid surrounding the mixing assembly.

Figure 1:
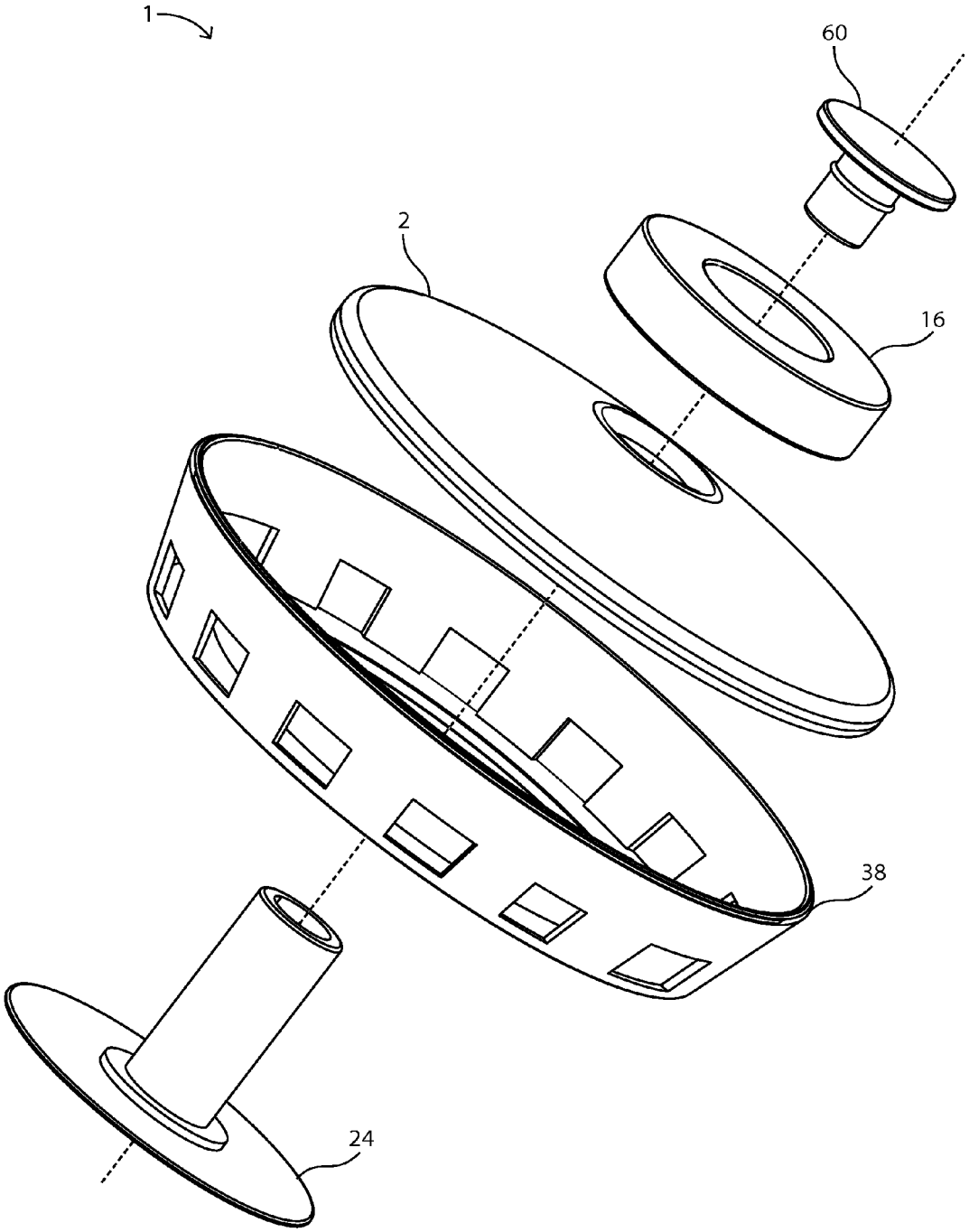
FIG. 1 includes an exploded perspective view of a mixing assembly in accordance with an embodiment.
Figure 2:
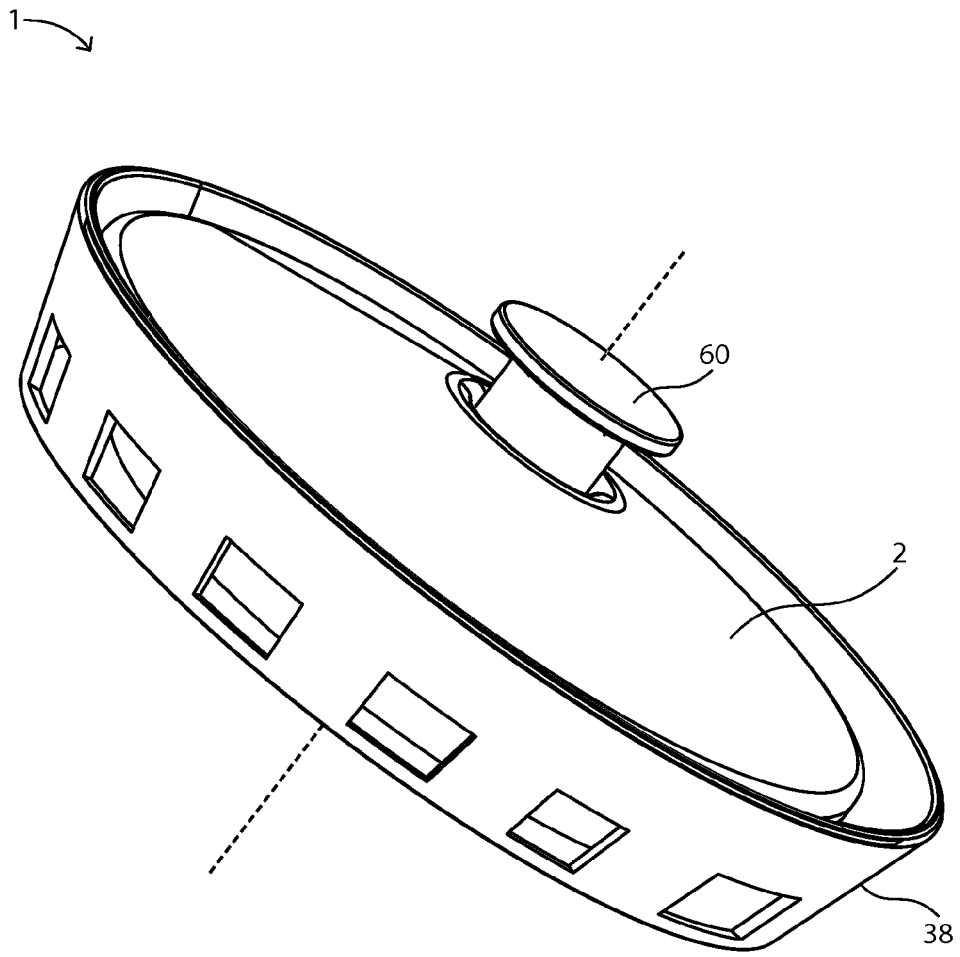
FIG. 2 includes a perspective view of a mixing assembly in accordance with an embodiment.

Referring initially to FIG. 1, an exploded view of a first embodiment of a mixing assembly 1 is shown and the mixing assembly 1 in assembled configuration is illustrated in FIG. 2. The mixing assembly 1 can include a fluid agitating element 2, which can be adapted to slidably couple to a support 24 along a central axis 4 such that the fluid agitating element 2 can be reciprocated along the central axis 4. Moreover, the mixing assembly can further include a diffusing element 38, upon which the reciprocation of the fluid agitating element 2 can force fluid toward and at least partly through the diffusing element 38. In this way, the fluid agitating element 2 can be adapted to impart a mixing action into a fluid surrounding the mixing assembly 1

As discussed above, the mixing assembly 1 can further include a support 24 engaged with the fluid agitating element. The support can be a static support and adapted to be stationary. For example, in particular embodiments, the support 24 can be coupled or even directly attached to or integrally formed within the interior of a vessel 34. Generally, the support 24 can be coupled to the interior of the vessel on the bottom wall, a top wall, a side wall, or any combination thereof. In particular embodiments, the support 24 can be coupled to the interior of the vessel on the bottom wall.

Figure 3:
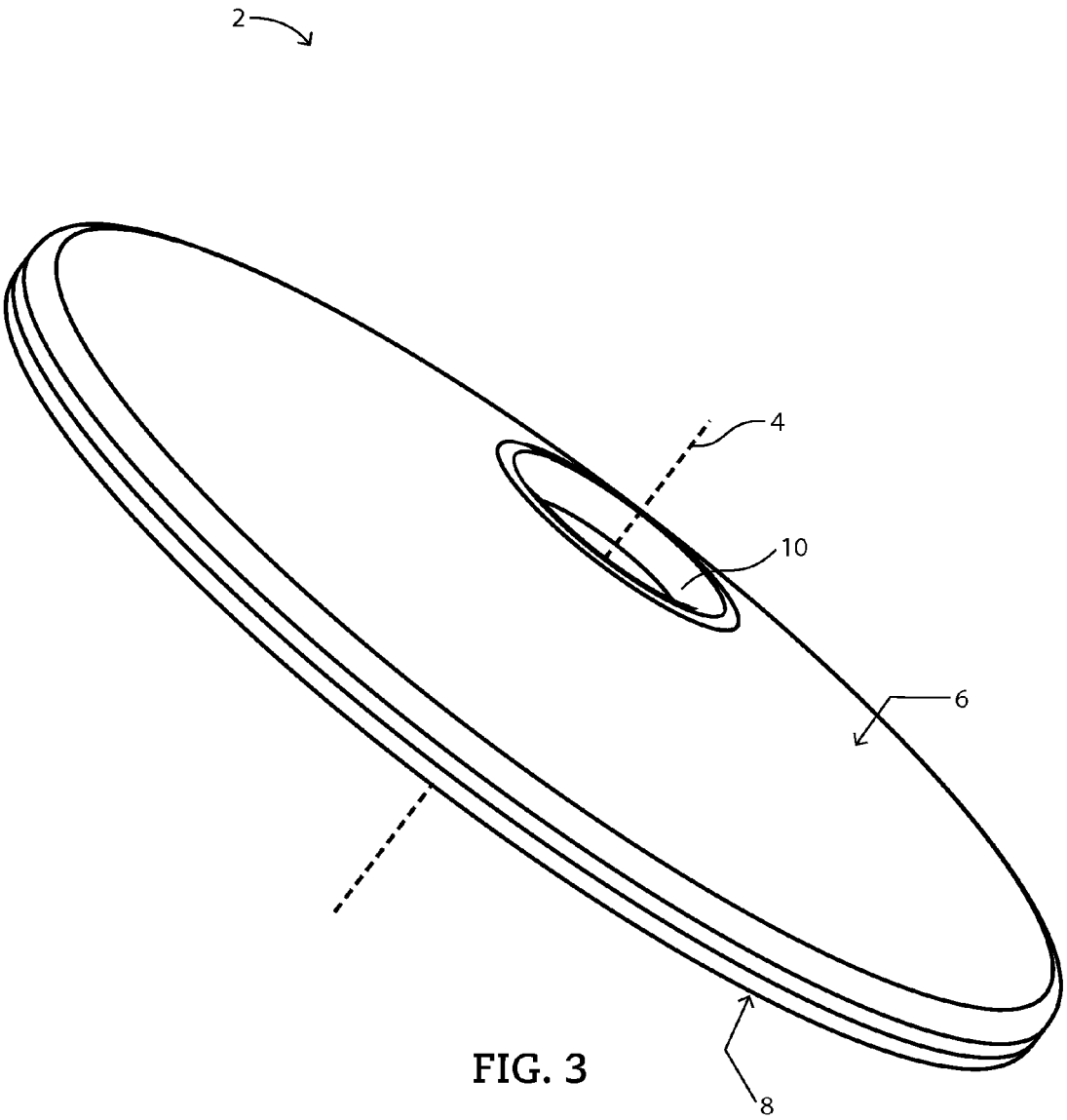
FIG. 3 includes a perspective view of a fluid agitating element in accordance with an embodiment.

Referring now to FIG. 3 to FIG. 8, there are illustrated particular embodiments of the fluid agitating element. The fluid agitating element 2 can have a first major surface 6 and a second major surface 8. Generally, the first and second major surfaces 6, 8 are adapted to interact with the fluid to be mixed during operation. The fluid agitating element 2 can have any shape which allows the fluid agitating element to agitate a fluid. For example, and as illustrated in FIG. 3, the fluid agitating element 2 can include a generally planar disc having a central aperture 10 for engagement with the support 24. In other particular embodiments, the fluid agitating element 2 can have a generally frustoconical shape, a dome shape, a generally toroidal shape, or any combination thereof. Further, the first and second major surfaces 6, 8 of the fluid agitating element 2 can be radially tapered regardless of the shape of the fluid agitating element.

The fluid agitating element 2 can have any general profile when viewed from above. In particular embodiments, the fluid agitating element 2 can have a generally circular shape, a pyramidal shape, a polygonal shape, or any combination thereof when viewed from above. In particular embodiments, and as illustrated in FIG. 4, the fluid agitating element 2 can have a substantially rounded outer edge so as to form a generally circular shape when viewed from above.

Figure 4:
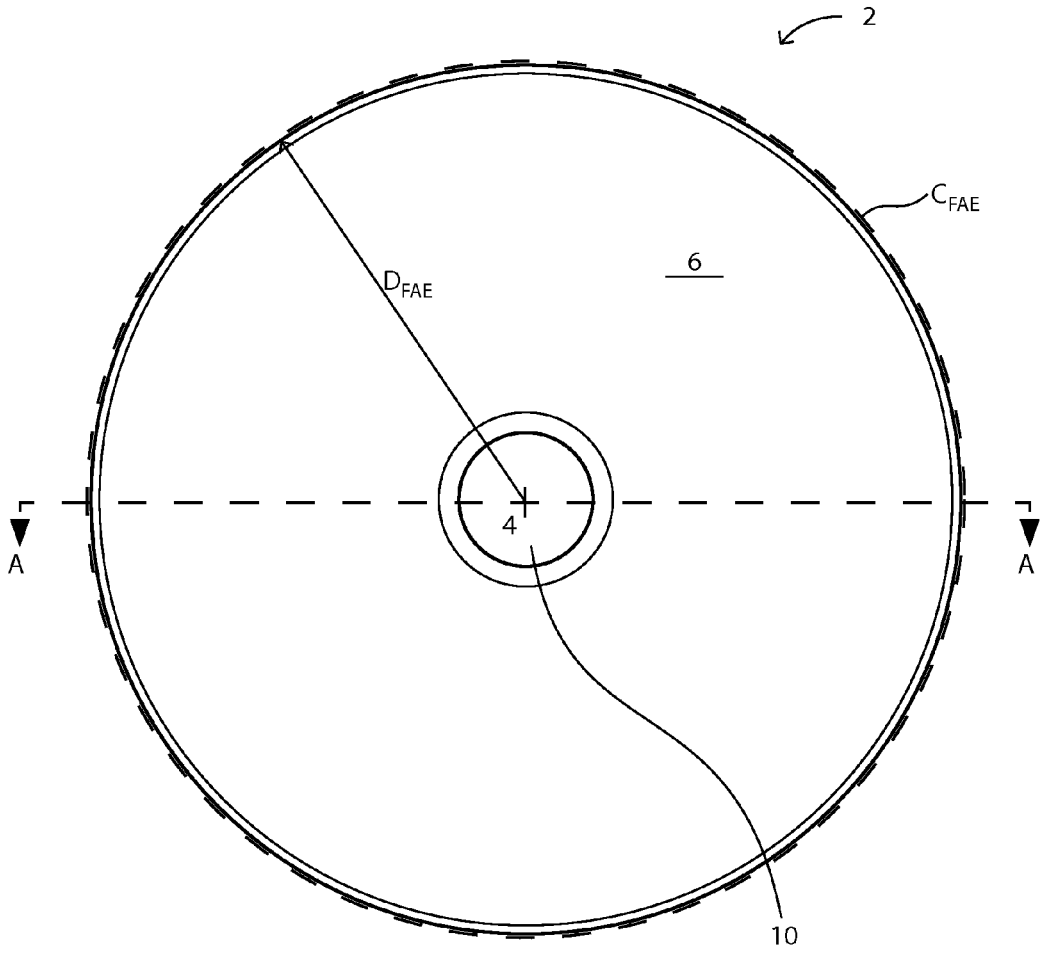
FIG. 4 includes a top plan view of a fluid agitating element in accordance with an embodiment.

As illustrated in FIG. 4, in a particular embodiment the fluid agitating element 2 can have an outer circumference, $C_{FAE}$, as measured by a best fit circle tangent to an outer edge of the fluid agitating element 2. Additionally, the fluid agitating element 2 can have a diameter, $D_{FAE}$, as measured from a first edge of the fluid agitating element 2 to a second opposing edge of the fluid agitating element 2.

In a particular embodiment, the fluid agitating element 2 can have a maximum height, $H_{FAE}$, as measured along the central axis 4. A ratio of $D_{FAE}$:$H_{FAE}$ can be no less than 0.2, no less than 0.3, no less than 0.4, no less than 0.5, no less than 0.6, no less than 0.7, no less than 0.8, no less than 0.9, no less than 1.0, no less than 1.1, no less than 1.2, no less than 1.3, no less than 1.4, no less than 1.5, no less than 1.6, no less than 1.7, no less than 1.8, no less than 1.9, no less than 2.0, no less than 3.0, no less than 4.0, no less than 5.0, no less than 10.0. The ratio of $D_{FAE}$:$H_{FAE}$ can be no greater than 1000, such as no greater than 900, no greater than 800, no greater than 700, no greater than 600, no greater than 500, no greater than 400, no greater than 300, no greater than 200, no greater than 100, no greater than 75, no greater than 50, no greater than 25, no greater than 20, no greater than 15, no greater than 10, no greater than 5. The ratio of $D_{FAE}$:$H_{FAE}$ can also be within a range between and including any of the ratio values described above, such as, for example, between 1.0 and 5.0.

Figure 5:
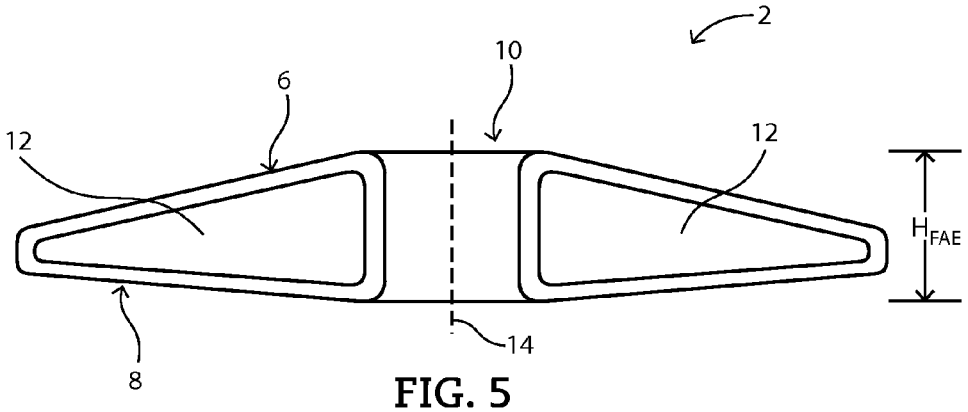
FIG. 5 includes a cross-sectional side view of a fluid agitating element in accordance with an embodiment taken along line A-A of FIG. 4.
Figure 6:
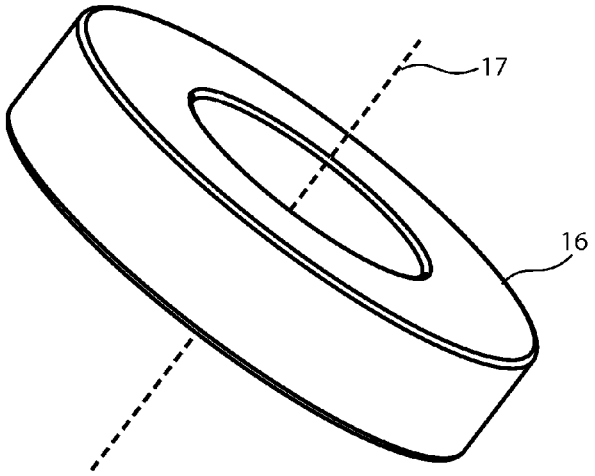
FIG. 6 includes a perspective view of a magnetic element in accordance with an embodiment.

Referring now to FIG. 5 to FIG. 6, in particular embodiments, the fluid agitating element 2 can have an internal cavity 12 which can be at least partially or wholly disposed within the fluid agitating element 2. The internal cavity 12 can form any shape within the fluid agitating element 2. For example, the internal cavity 12 can be toroidal or tapered. The internal cavity 12 can have any cross-sectional profile, such as rectilinear, circular, triangular, polygonal, or any combination thereof. In certain embodiments, the internal cavity 12 can have a shape which complements the outer profile and dimensions of the magnetic element, as will be described in more detail below.

As illustrated in FIG. 5, the internal cavity 12 can extend concentrically around the central aperture 10 of the fluid agitating element 2. In another embodiment, the internal cavity 12 can have a central axis 14 that is not coaxial with the central axis 4 of the fluid agitating element 2. In this regard, the two central axes 4, 14 can be angularly misaligned or perpendicularly offset from one another.

The internal cavity 12 can be a sealed environment such that it is sealed from the surrounding fluid to be mixed. In particular embodiments, the internal cavity can be hermetically sealed. Moreover, as shown in FIG. 5, the fluid agitating element can be a monolithic piece, and the internal cavity 12 can be formed during formation of the fluid agitating element 2.

Referring again to FIG. 1 and FIG. 6, the mixing assembly 1 can further include a magnetic member 16 which can be adapted to engage with a drive device located outside the vessel. The magnetic member can be engaged or coupled to the fluid agitating element in any manner that allows the magnetic member to translate the fluid agitating element. In particular embodiments, the magnetic member 16 can be positioned within the internal cavity 12 of the fluid agitating element 2. For example, the fluid agitating element 2 can be over-molded onto the magnetic member 16. In another aspect, and as particularly illustrated in FIG. 6, the fluid agitating element 2 can comprise two independent components 92, 94 which can be joined together after insertion of the magnetic member 16 therein. In any arrangement of the magnetic member 16 and the fluid agitating element, the magnetic member can be sealed and particularly hermetically sealed from the fluid surround the mixing assembly. In this way, the magnetic element, which can be reactive to the fluid being mixed, can be prevented from chemical interaction with the fluid.

Figure 7:
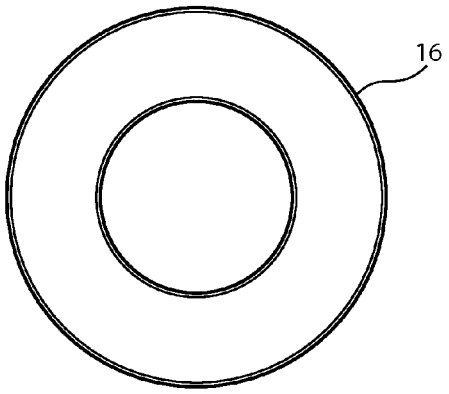
FIG. 7 includes a top plan view of a magnetic element in accordance with an embodiment.
Figure 8:
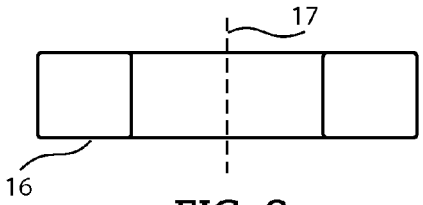
FIG. 8 includes a cross-sectional side view of a magnetic element in accordance with an embodiment taken along Line B-B in FIG. 7.
Figure 9:
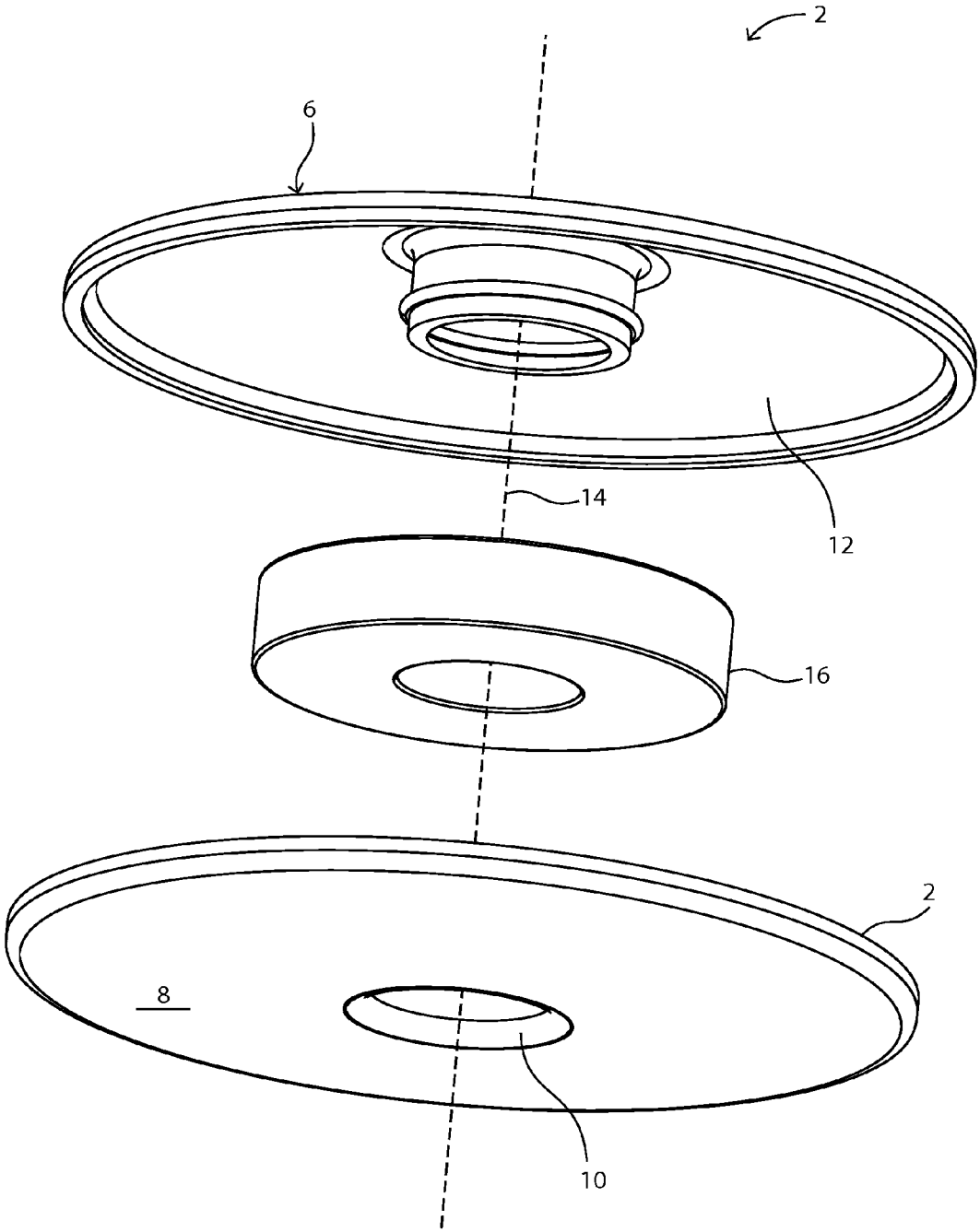
FIG. 9 includes an exploded perspective view of a fluid agitating element and a magnetic element in accordance with an embodiment.
Figure 10:
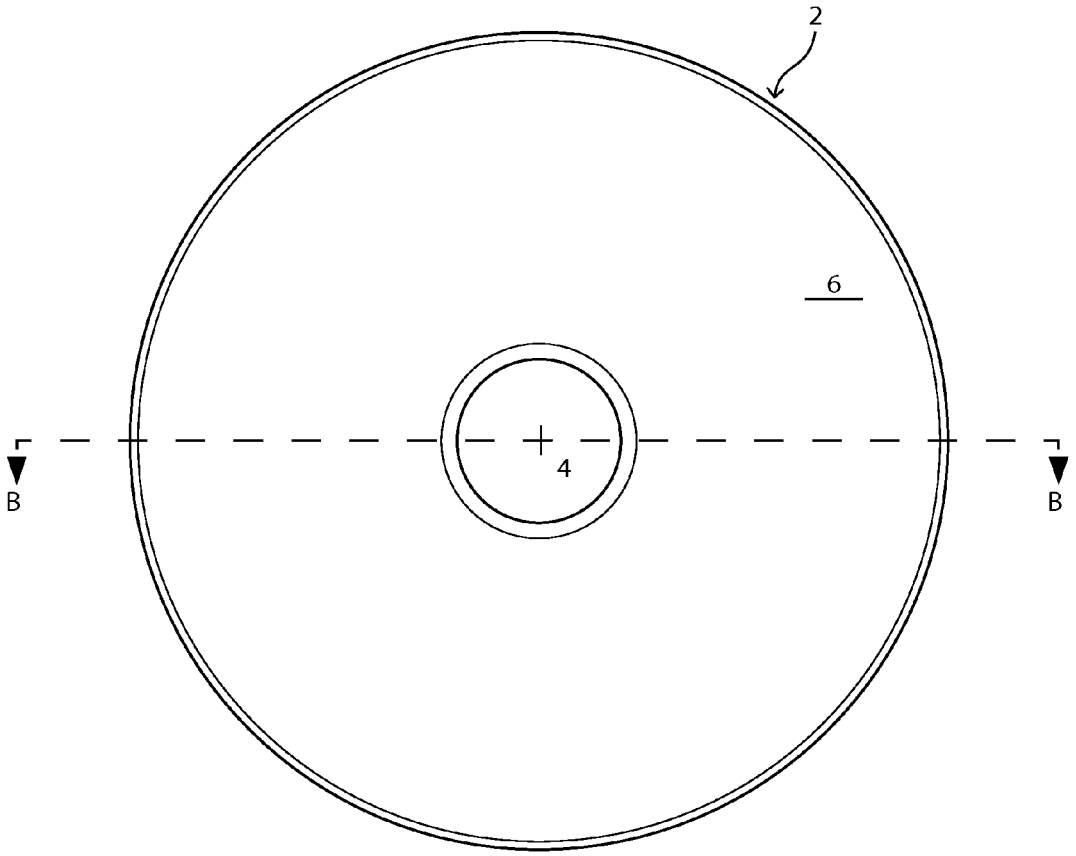
FIG. 10 includes a top plan view of a fluid agitating element and a magnetic element in accordance with an embodiment.
Figure 11:
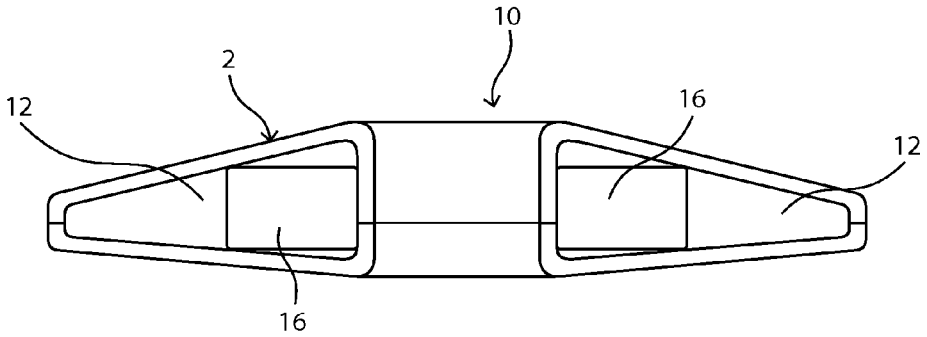
FIG. 11 includes a cross-sectional side view of a fluid agitating element and a magnetic element in accordance with an embodiment.

The magnetic member 16 can have any general shape or profile. Referring to FIG. 6 through FIG. 8, in certain embodiments, the magnetic member 16 can have a generally toroidal shape. The magnetic member 16 can be sized to fit within the internal cavity 12 of the fluid agitating element 2. In a particular embodiment, the magnetic member 16 can occupy the entire volume formed by the internal cavity 12. In a further embodiment, the magnetic member 16 can have a lesser volume than the internal cavity 12. In this regard, any number of shims or spacers (not shown) can be incorporated into the internal cavity 12 to prevent movement of the magnetic member 16 therein.

In a particular embodiment, the magnetic member 16 can be secured within the internal cavity 12 by an adhesive. In another embodiment, the magnetic member 16 can be mechanically deformed or can have a non-symmetrical shape adapted to the contour of the internal cavity 12. In a further embodiment, the magnetic member 16 and the fluid agitating element 2 can have at least one poka-yoke. As referred to herein, a "poka-yoke" is an engagement means for aligning and maintaining components relative to each other at a desired position and/or orientation. The poka-yoke can include a tab extending from one of the magnetic member 16 and the fluid agitating element 2. The tab can be adapted to engage with a corresponding slot within the other of the magnetic member 16 and fluid agitating element 2. In yet another embodiment, the magnetic member 16 can be free to move relative to the internal cavity 12 of the fluid agitating element 2. In this regard, the magnetic member 16 can be adapted to rotate or slidably oscillate within the internal cavity 12.

The magnetic member 16 can be any material that is capable of magnetic interaction with a drive device. For example, in particular embodiments, the magnetic member can include a ferromagnetic. In this regard, the magnetic member can be selected from a ferromagnetic material including steel, iron, cobalt, nickel, and earth magnets. In a further embodiment, the magnetic member 16 can be a magnetic material.

The magnetic member can have any number of poles in any orientation, depending on the type of drive device. In certain embodiments, the magnetic member 16 can be bipolar, having both a positive and a negative pole.

Referring again to FIG. 1, in a particular embodiment the mixing assembly 1 can further include a diffusing element 38. As the fluid agitating element 2 reciprocates, fluid can be forced toward and at least partly through the diffusing element 38. The diffusing element 38 can be a monolithic piece and can be a separate and distinct element from the vessel. In other embodiments, the diffusing element 38 can be integrally formed as a part of the vessel, or otherwise coupled, directly or indirectly, to a vessel or mixing dish, as will be described in more detail below.

Figure 12:
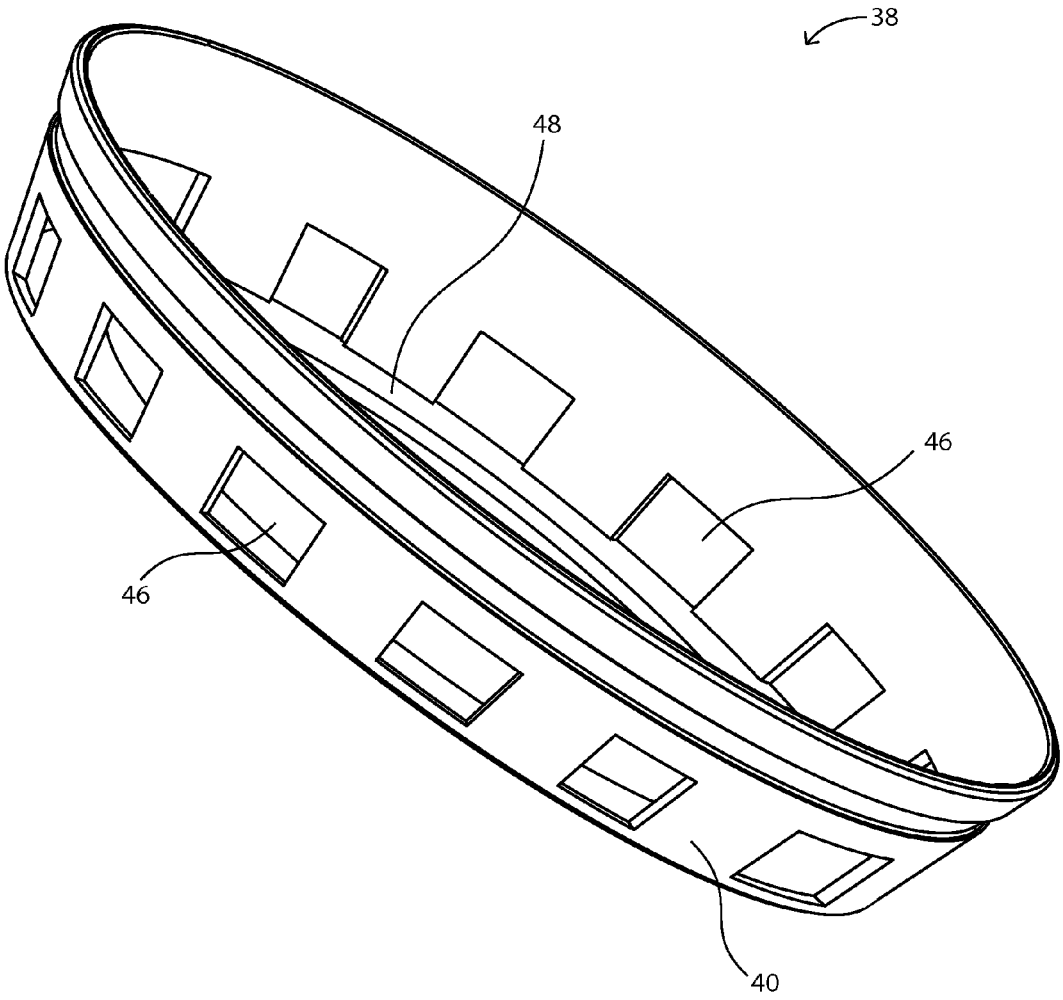
FIG. 12 includes a perspective view of a diffusing element in accordance with an embodiment.
Figure 13:
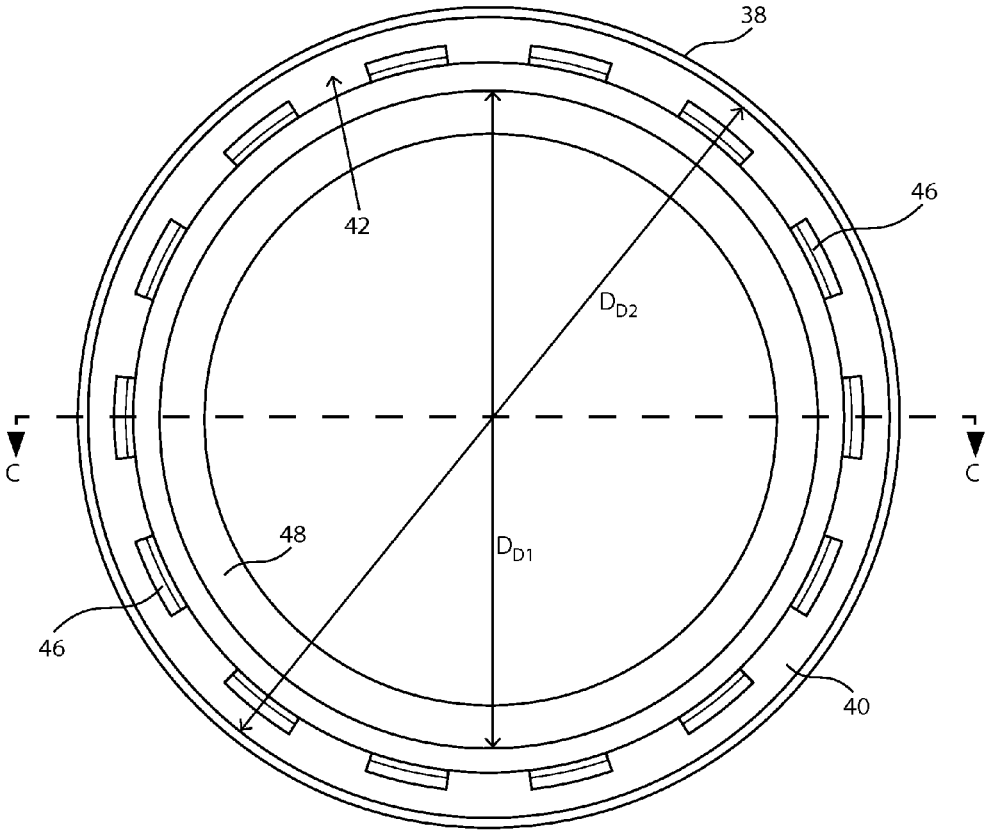
FIG. 13 includes a top plan view of a diffusing element in accordance with an embodiment.
Figure 14:
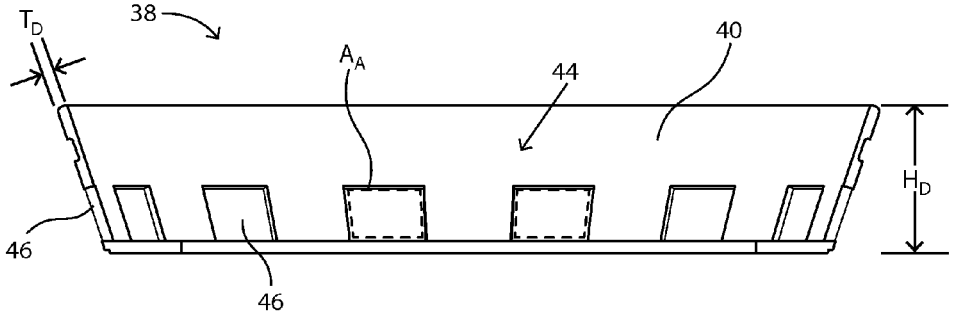
FIG. 14 includes a cross-sectional side view of a diffusing element in accordance with an embodiment taken along Line C-C in FIG. 13.
Figure 15:
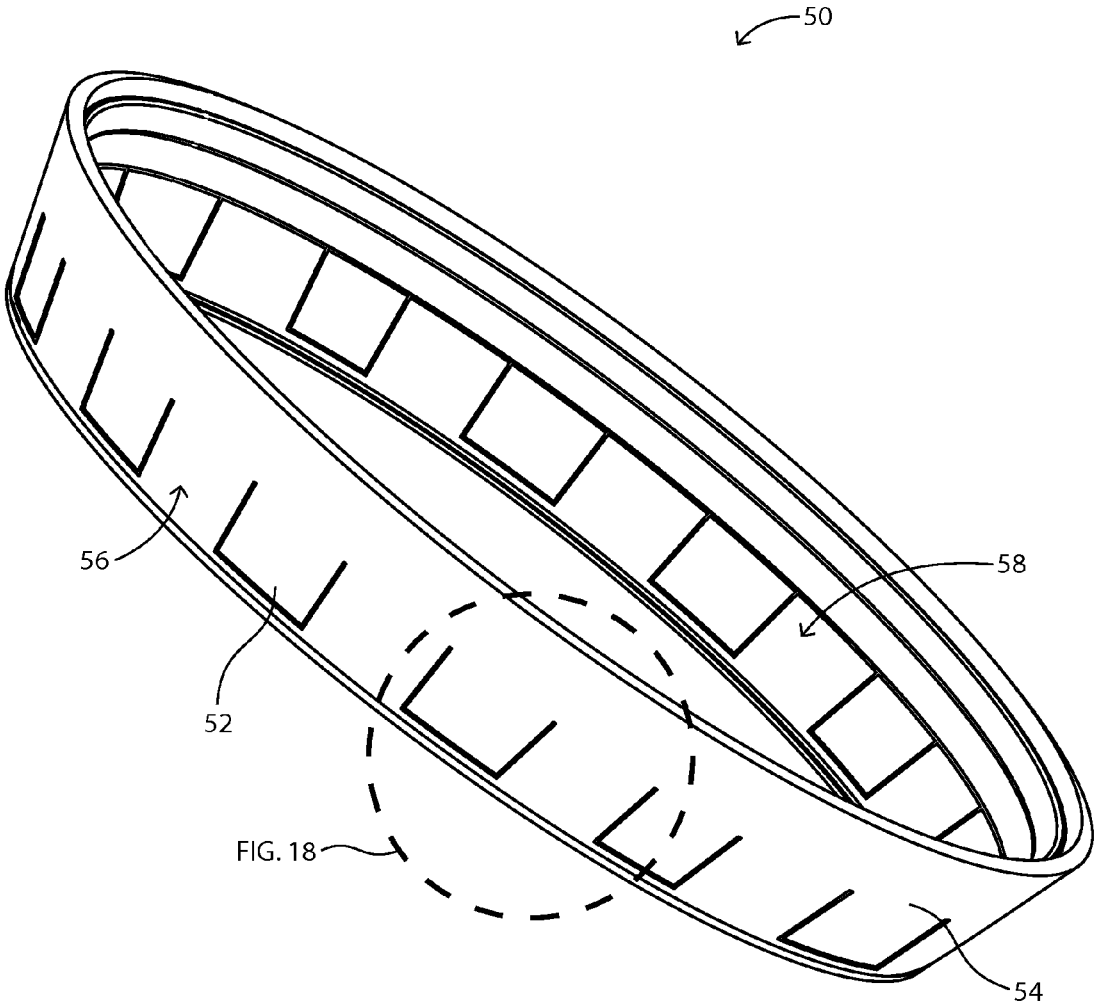
FIG. 15 includes a perspective view of a valve element in accordance with an embodiment, wherein the valve element is in the closed position.
Figure 16:
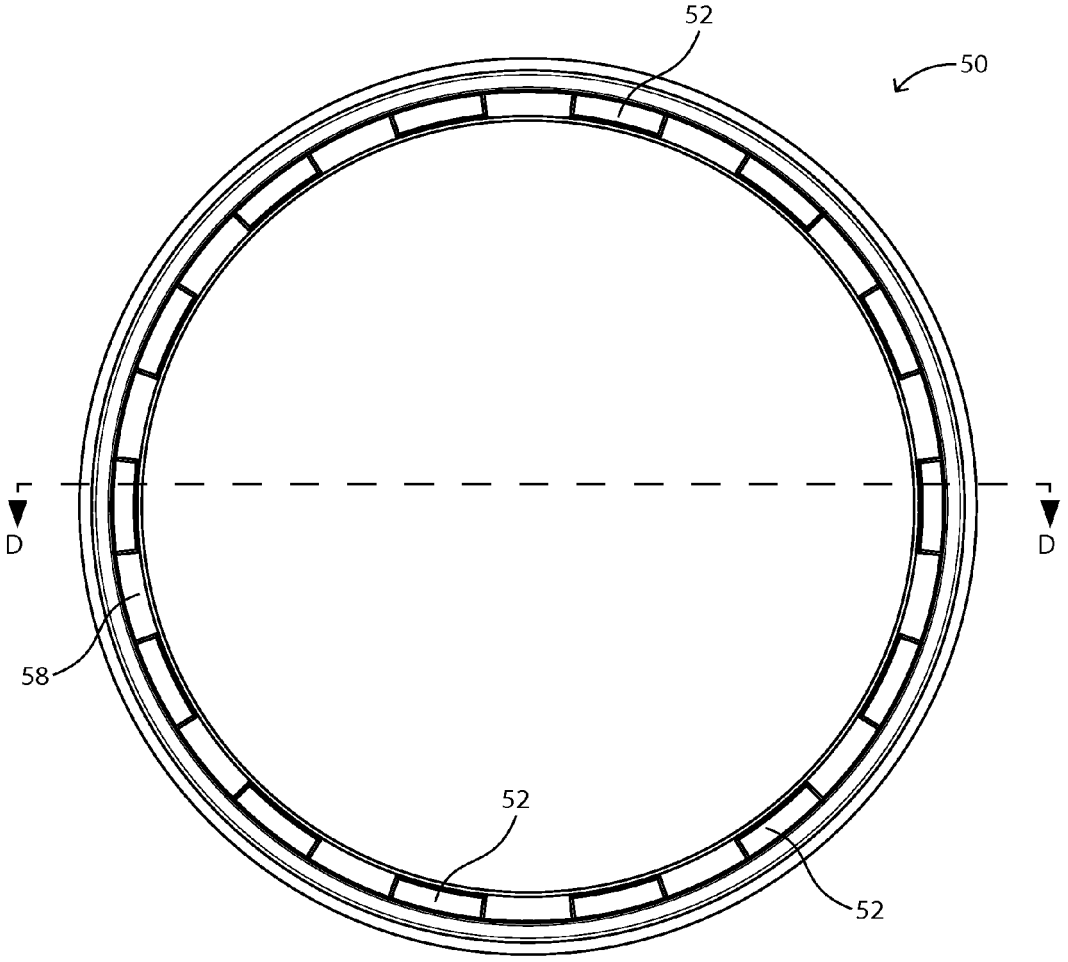
FIG. 16. includes a top plan view of a valve element in accordance with an embodiment, wherein the valve element is in the closed position.
Figure 17:
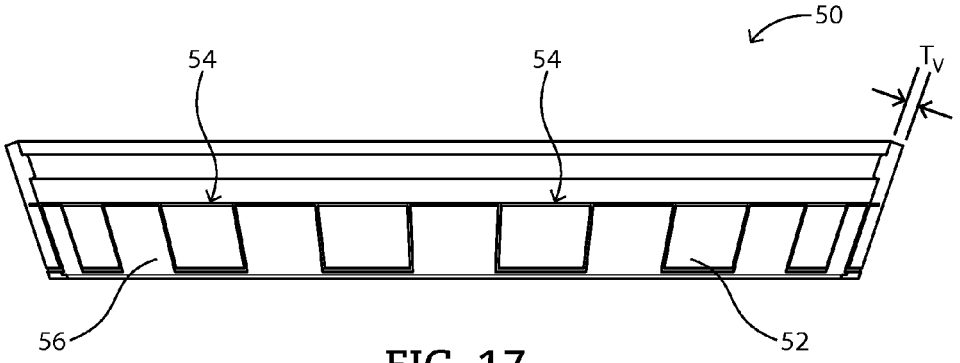
FIG. 17 includes a cross-sectional side view of a valve element in accordance with an embodiment taken along Line D-D in FIG. 16.

Referring to FIG. 12 through FIG. 14, the diffusing element 38 can have any shape. In particular embodiments, the diffusing element 38 can have a shape which complements the profile of the fluid agitating element. In particular embodiments, the diffusing element 38 can be generally annular and can have a first diameter, $D_{D1}$. A ratio of $D_{D1}$:$D_{FAE}$ can be at least 1.01, at least 1.02, at least 1.03, at least 1.04, at least 1.05, at least 1.10, at least 1.15, at least 1.20, at least 1.25, at least 1.30, at least 1.35, at least 1.40, at least 1.45, at least 1.50. The ratio of $D_{D1}$:$D_{FAE}$ can be no greater than 2.5, no greater than 2.0, no greater than 1.75, no greater than 1.70, no greater than 1.65, no greater than 1.60, no greater than 1.55, no greater than 1.50, no greater than 1.45, no greater than 1.40, no greater than 1.35, no greater than 1.30, no greater than 1.25, no greater than 1.20, no greater than 1.15, no greater than 1.10. Additionally, the ratio of $D_{D1}$:$D_{FAE}$ can be within a range between and including any of the ratios described above, such as, for example, between 1.01 and 1.10.

In further embodiments, the diffusing element 38 can have a substantially parallel sidewall 40. In another embodiment, the diffusing element 38 can be generally frustoconical. In this regard, the sidewall 40 can further include a second diameter, $D_{D2}$. A ratio of $D_{D2}$:$D_{D1}$ can be no less than 1.01, no less than 1.05, no less than 1.10, no less than 1.15, no less than 1.20, no less than 1.25, no less than 1.30, no less than 1.35. The ratio of $D_{D2}$:$D_{D1}$ can be no greater than 2.00, no greater than 1.75, no greater than 1.50, no greater than 1.40, no greater than 1.30, no greater than 1.20. The ratio of $D_{D2}$:$D_{D1}$ can be within a range between and including any of the ratios described above, such as, for example, between 1.01 and 1.20.

In yet another embodiment, the diffusing element 38 can have any other generally annular shape. For example, the diffusing element 38 can have a toroidal shape, a triangular shape, or a rectilinear shape. Additionally, the diffusing element 38 can be tapered, bent, twisted, curved, or orient in any direction or degree. In another particular embodiment, the diffusing element 38 can have any polygonal shape. In this regard, the diffusing element 38 can form a closed ring with a segmented sidewall 40.

The diffusing element 38 can have a height, $H_D$, as measured perpendicular to the diameter, $D_{D1}$, as measured between two diametrically opposite points on the diffusing element 38. In a particular aspect, a ratio of $H_D$:$D_{D1}$ can be no greater than 0.50, no greater than 0.45, no greater than 0.40, no greater than 0.35, no greater than 0.30, no greater than 0.25, no greater than 0.20, no greater than 0.15, no greater than 0.10. The ratio of $H_D$:$D_{D1}$ can be no less than 0.005, no less than 0.010, no less than 0.015, no less than 0.020, no less than 0.025, no less than 0.030, no less than 0.050, no less than 0.100, no less than 0.200, no less than 0.300, no less than 0.400. Additionally, the ratio of $H_D$:$D_{D1}$ can be within a range between and including any of the ratios described above, such as, for example, between 0.3 and 0.5.

In particular embodiments, the diffusing element 38 can comprise a metal. In further embodiments, the diffusing element 38 can comprise a polymer. In this regard, the diffusing element 38 can be formed from injection molding. The diffusing element 38 can be a monolithic piece or can include two or more separate components attached together. Attachment of the components can be performed by use of an adhesive, mechanical deformation (e.g., crimping of the components), welding, or any other method for joining two components together.

The diffusing element 38 can further include a plurality of apertures 46 positioned along the sidewall 40. The apertures 46 can be positioned on the sidewall 40 of the diffusing element 38 to allow for the passage of a fluid therethrough. The apertures 46 can comprise any shape cutout into the sidewall 40. For example, the apertures 46 can be rectilinear, circular, triangular, or can have any other polygonal shape.

In a particular aspect, the apertures 46 can be formed to have generally the same shape. The apertures 46 can also be formed to have generally the same size. In a particular aspect, the apertures 46 can be formed to have various shapes and/or sizes.

In particular embodiments, the apertures 46 can be positioned along a single plane on the sidewall 40 of the diffusing element 38. This alignment of the apertures 46 can help to facilitate equal fluidic mixing around the perimeter of the diffusing element 38. Alternatively, the apertures 46 can be formed on two or more planes along the sidewall 40 of the diffusing element 38. In this regard, the apertures 46 can generate uneven fluidic mixing characteristics around the perimeter of the diffusing element 38. Uneven fluidic mixing may be advantageous in situations where several components of varying density are to be mixed into a single solution.

In a particular embodiment, the sidewall 40 of the diffusing element 38 can have an inner surface area, $A_D$, and the apertures 46 can define a total area, $A_A$, as measured by the surface area of the diffusing element 38 devoid of material. A ratio of $A_D$:$A_A$ can be at least 1.1, at least 1.2, at least 1.3, at least 1.4, at least 1.5, at least 1.6, at least 1.7, at least 1.8, at least 1.9, at least 2.0, at least 2.1, at least 2.2, at least 2.3, at least 2.4, at least 2.5, at least 2.6, at least 2.7, at least 2.8, at least 2.9, at least 3.0, at least 3.5, at least 4.0, at least 4.5. The ratio of $A_D$:$A_A$ can be no greater than 100, no greater than 75, no greater than 50, no greater than 40, no greater than 30, no greater than 20, no greater than 15, no greater than 10, no greater than 5, no greater than 4, no greater than 3, no greater than 2. Additionally, the ratio of $A_D$:$A_A$ can be within a range between and including any of the values described above, such as, for example, between 2.7 and 5.0. As the ratio of $A_D$:$A_A$ increases, the volume of fluid that is permitted passage through the apertures 46 of the diffusing element 38 can increase.

In particular embodiments, the diffusing element 38 can further include a radial flange 48. The radial flange 48 can extend from an end of the diffusing element 38 and can allow the diffusing element 38 to engage with an inner wall of the vessel. The radial flange 48 can be formed from the sidewall 40 of the diffusing element 38 by bending a section of the sidewall 40 radially inward or outward. To facilitate easier radial bending, the radial flange 48 can include a plurality of splays or cuts (not shown). In particular, the splays can be oriented substantially perpendicular to the central point (not shown) of the diffusing element 38.

Referring to FIG. 15 to FIG. 22, the mixing assembly 1 can further include a valve element 50 engaged with the diffusing element 38. Referring initially to FIG. 15 through FIG. 18, the valve element 50 can engage with the diffusing element 38 and can be adapted to prevent fluid flow through the apertures 46 of the diffusing element 38 in a single radial direction (i.e., radially inward or radially outward). The valve element 50 can include a plurality of gates 52 at least partially aligned with the apertures 46. The gates 52 can have substantially the same size and shape as the apertures 46 such that they can block fluid from flowing through the apertures 46. In another embodiment, the gates 52 can be larger than the apertures 46 such that the gates 52 overlap onto the sidewall 40 of the diffusing element 38. When the gates 52 are in a first position, as illustrated in FIG. 15 through FIG. 18, the apertures 46 can substantially block fluid flow through the apertures 46.

In particular embodiments, the valve element 50 can comprise a substantially flexible material such as a polymer, a thermoplastic material, an elastomer, a silicone based material, or any combination thereof. In other embodiments, the valve element 50 can include multiple materials. For example, the gates 52 of the valve element 50 can comprise a first material while the remainder of the valve element 50 comprises an alternate material. In this regard, the gates 52 can have a greater flexibility than the remainder of the valve element 50.

In particular embodiments, the valve element 50 can have a greater flexibility than the diffusing element 38. In this regard, the valve element 50 can operatively permit fluid flow through the apertures 46 while the diffusing element 38 can maintain rigidity and structural integrity during operation of the mixing assembly 1.

The valve element 50 can have an average radial thickness, $T_V$. Additionally, the diffusing element 38 can have an average radial thickness, $T_D$. In particular embodiments, the thickness of the valve element 50 can be greater than the thickness of the diffusing element 38. In another embodiment, $T_D$ can be equal to $T_V$. In yet a further embodiment, $T_D$ can be less than $T_V$.

In one embodiment, a ratio of $T_D$:$T_V$ can be at least 0.01, at least 0.02, at least 0.03, at least 0.04, at least 0.1, at least 0.2, at least 0.3, at least 0.4, at least 0.5, at least 0.6, at least 0.7, at least 0.8, at least 0.9, at least 1.0, at least 1.1, at least 1.2, at least 1.3, at least 1.4, at least 1.5, at least 1.6, at least 1.7, at least 1.8, at least 1.9, at least 2.0. In this embodiment, the ratio of $T_D$:$T_V$ can be no greater than 100, no greater than 50, no greater than 25, no greater than 10, no greater than 9, no greater than 8, no greater than 7, no greater than 6, no greater than 5, no greater than 4, no greater than 3, no greater than 2. Additionally, in this embodiment, the ratio of $T_D$:$T_V$ can be within a range between and including any of the values described above.

The relative radial thickness of the diffusing element 38 and the valve element 50 can be determinative of the radial strength of the assembly 1. For example, the gates 52 of the valve element 50 can be formed with a greater thickness if the material selected for the valve element 50 is flexible and incapable of preventing the passage of fluid through the apertures 46 during operation. In this regard, the gates 52 of the valve element 50 can further include a rigid, or semi-rigid, framework (not shown) which can maintain the structural integrity of the gates 52 and prevent the gates 52 from collapsing or folding during operation of the mixing assembly 1. The framework (not shown) can be internally disposed within the gates 52, externally engaged with the gates 52, or partly internal within the gates 52. The framework can include a relatively rigid material arranged to provide sufficient structural integrity to the gates 52.

In a particular embodiment, the valve element 50 can be concentrically positioned radially inside of the sidewall 40 of the diffusing element 38. In this regard, an exterior surface 56 of the valve element 50 can be contoured to sit substantially flush with an inner surface 42 of the diffusing element 38. In another embodiment, the valve element 50 can be concentrically positioned radially outside of the sidewall 40 of the diffusing element 38. In this regard, an interior surface 58 of the valve element 50 can be contoured to sit substantially flush with an exterior surface 44 of the diffusing element 38. In yet a further embodiment, the valve element 50 can be integral with the diffusing element 38. In this regard, the diffusing element 38 can include a central gap (not shown) wherein the valve element 50 can be disposed. Alternatively, the diffusing element 38 can integrally include gates in relative communication with the apertures 46 of the diffusing element 38. These integral gates can substantially prohibit fluid flow in a single radial direction (i.e., radially inward or radially outward).

Figure 18:
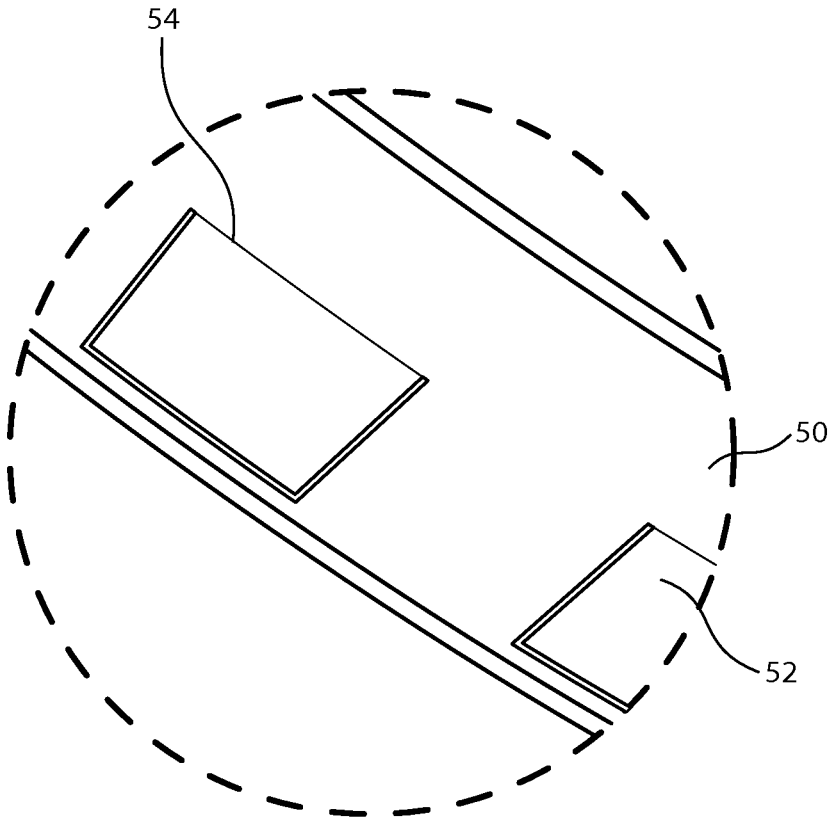
FIG. 18 includes an enlarged perspective view of a valve element in accordance with an embodiment taken from Circle E-E in FIG. 15.
Figure 19:
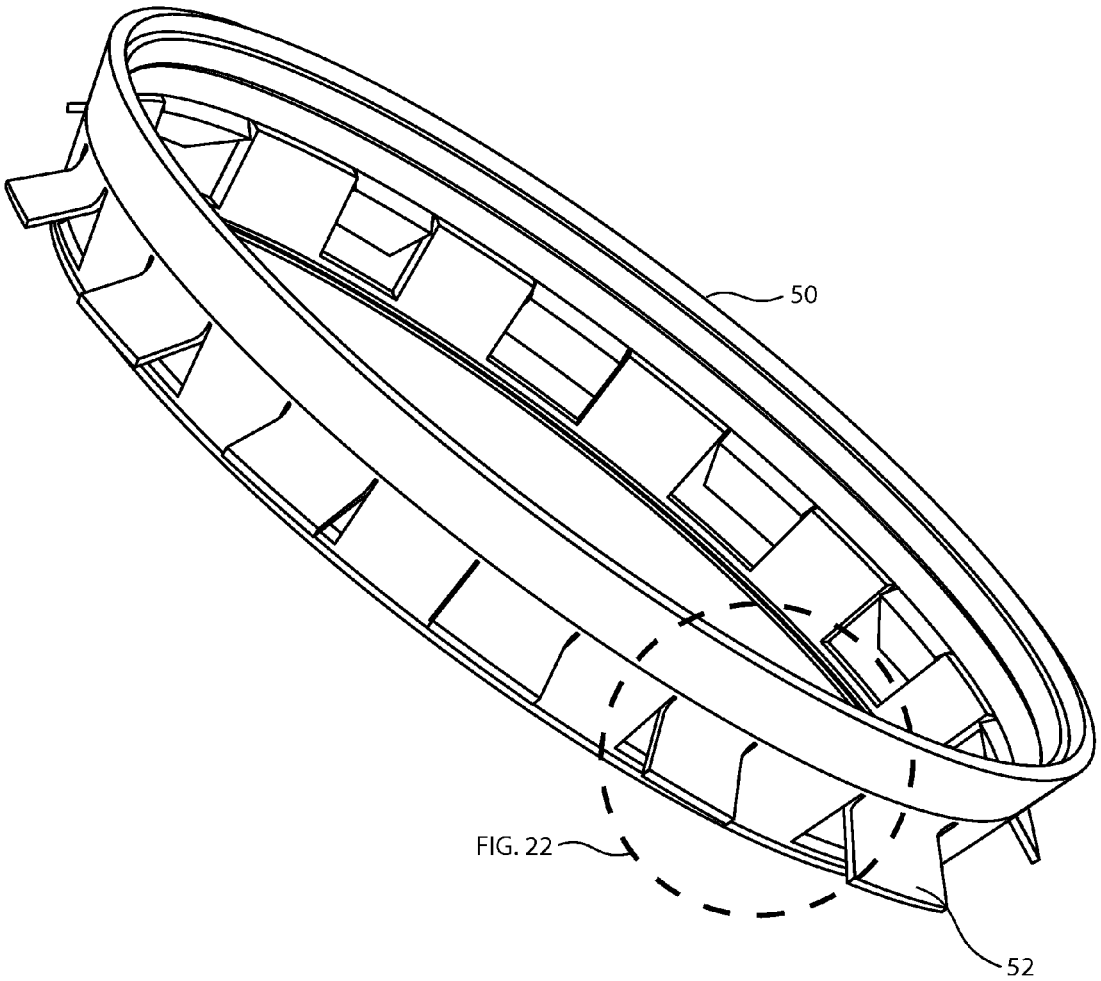
FIG. 19 includes a perspective view of a valve element in accordance with an embodiment, wherein the valve element is in the open position.
Figure 20:
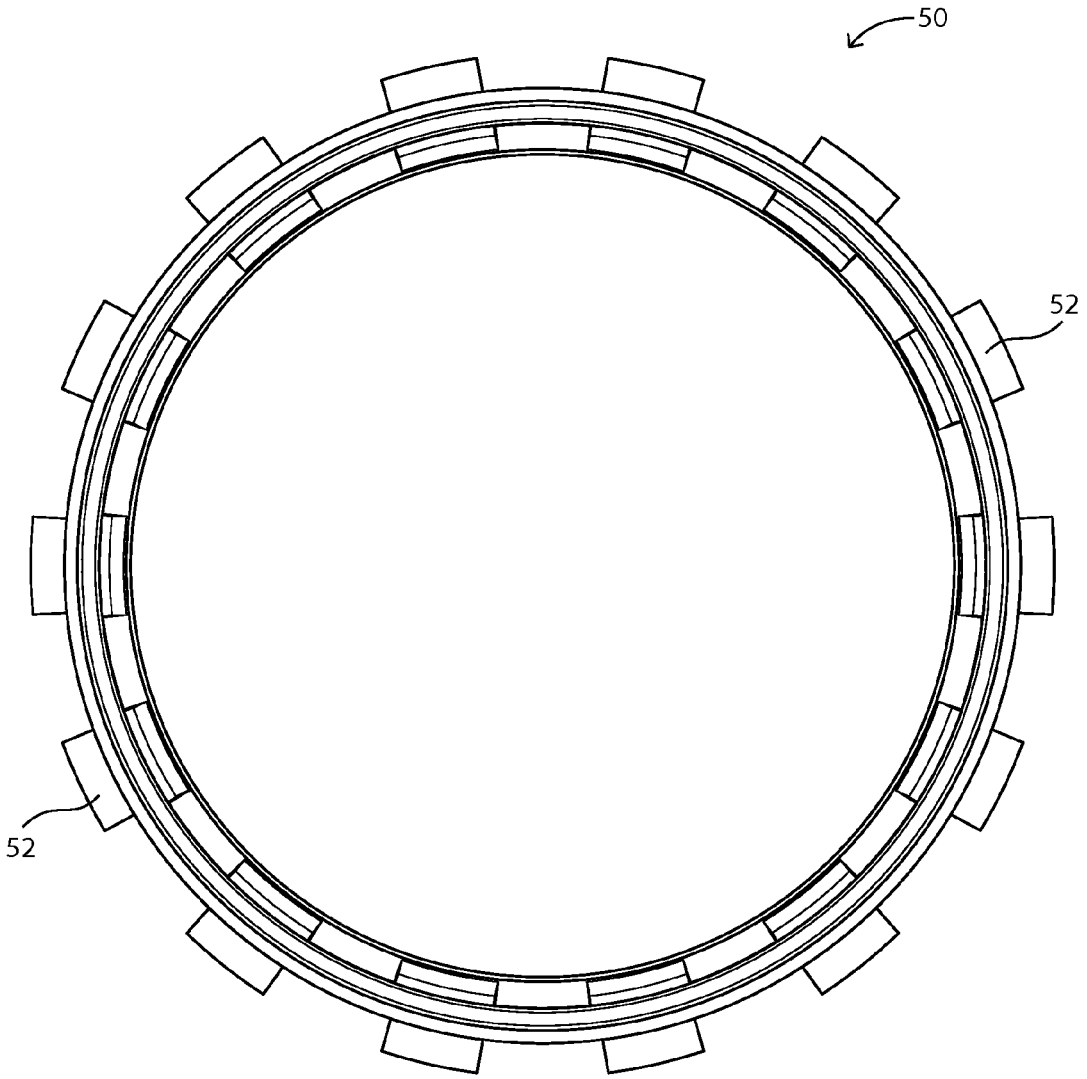
FIG. 20 illustrates a top plan view of a valve element in accordance with an embodiment, wherein the valve element is in the open position.
Figure 21:
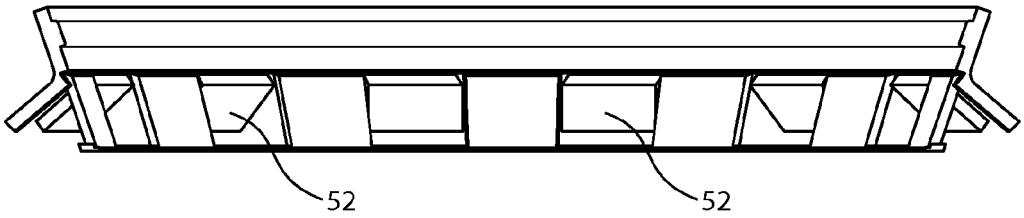
FIG. 21 includes a cross-sectional side view of a valve element in accordance with an embodiment taken along Line F-F in FIG. 20.
Figure 22:
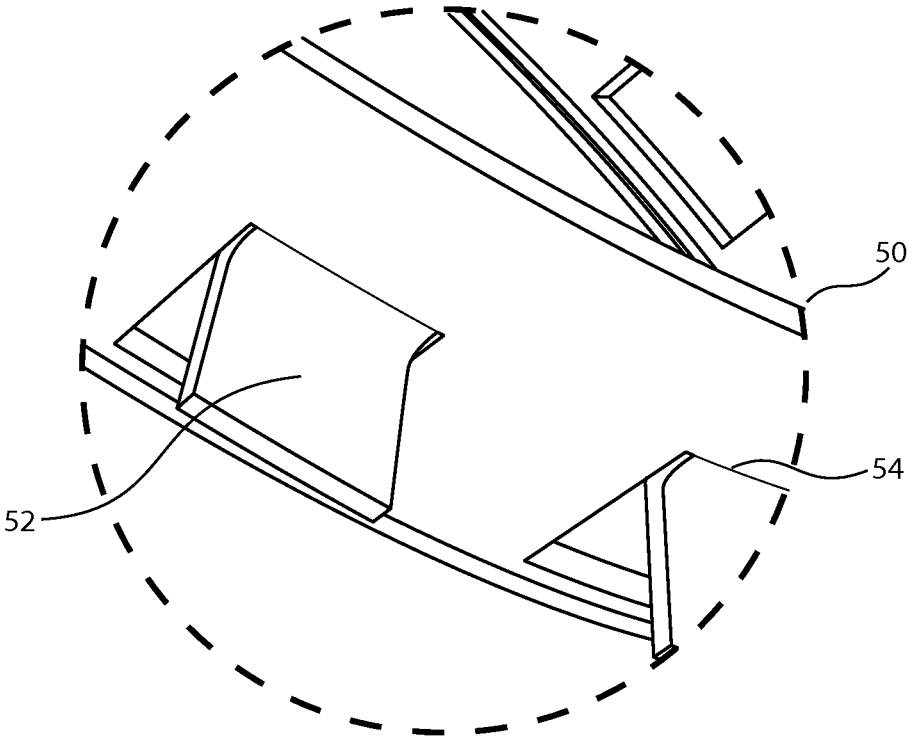
FIG. 22 includes an enlarged perspective view of a valve element in accordance with an embodiment taken from Circle G-G in FIG. 19.

Referring to FIG. 18, the gates 52 on the valve element 50 can further include a hinge element 54. The hinge element 54 can include a thin strip of material adapted to permit the gates 52 to pivotally rotate a total angle of at least 10 degrees, at least 20 degrees, at least 30 degrees, at least 40 degrees, at least 50 degrees, at least 60 degrees, at least 70 degrees, at least 80 degrees, at least 90 degrees, at least 100 degrees. The hinge element 54 can be adapted to prohibit the gates 52 from pivotally rotating more than 180 degrees, more than 170 degrees, more than 160 degrees, more than 150 degrees, more than 140 degrees, more than 130 degrees, more than 120 degrees, more than 110 degrees, more than 100 degrees, more than 90 degrees, more than 80 degrees. Additionally, the angle of pivotal rotation of the gates 52 through the hinge element 54 can be within a range between and including any of the values described above.

In a particular embodiment, the gates 52 can be adapted to allow fluid flow through the diffusing element 38 in a single radial direction (e.g., radially inward or radially outward). As illustrated in FIG. 19 to FIG. 22, the gates 52 can be adapted to pivotally rotate to a second position wherein fluid flow through the apertures 46 of the diffusing element 38 is permitted. In the second position, the gates 52 can allow fluid to pass radially outward through the apertures 46 of the diffusing element 38 when a first pressure radially inside of the diffusing element 38 is greater than a second pressure radially outside of the diffusing element 38. The resulting pressure gradient between the first pressure and the second pressure can permit the gates 52 to rotate from the first position to the second position. As the pressure gradient decreases, the gates 52 can be return to the first position, thereby substantially impeding fluid flow through the diffusing element 38 in a radially inward direction.

Figure 23:
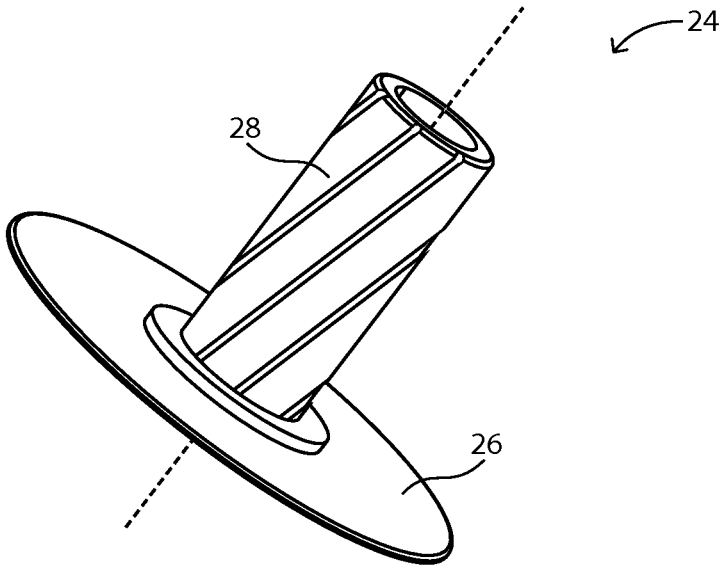
FIG. 23 includes a perspective view of a support in accordance with an embodiment.
Figure 24:
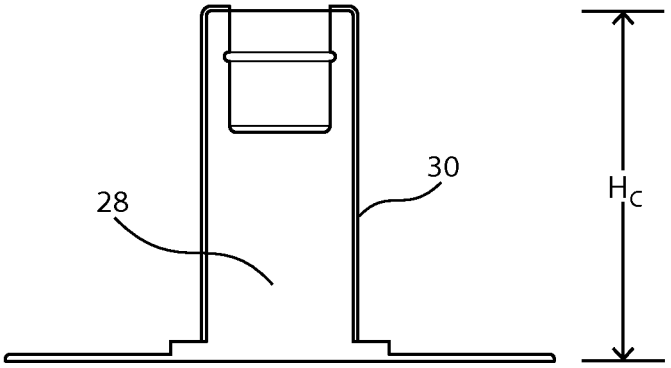
FIG. 24 includes a cross-sectional side view of a support in accordance with an embodiment.
Figure 25:
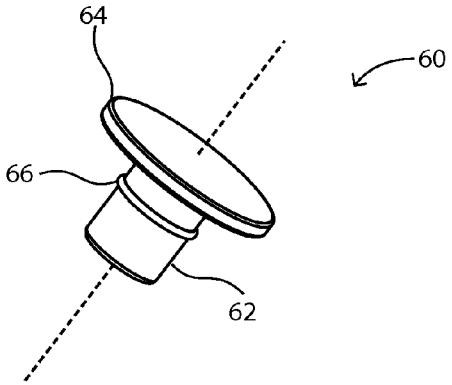
FIG. 25 includes a perspective view of a plug in accordance with an embodiment.

Referring now to FIG. 23 and FIG. 24, the support 24 can include a base 26 and a column 28 extending therefrom. The column 28 can have a height, $H_C$, along which the fluid agitating element 2 can be adapted to translate. In a particular aspect, the fluid agitating element 2 can translate along the support 24 a stroke distance, S, as defined by the height of the column 28 minus the height of the fluid agitating element 2.

A ratio of $S:D_{FAE}$, can be no less than 0.05, no less than 0.10, no less than 0.20, no less than 0.30, no less than 0.40, no less than 0.50, no less than 0.60, no less than 0.70, no less than 0.80, no less than 0.90, no less than 1.0, no less than 1.5. The ratio of $S:D_{FAE}$ can be no greater than 100, no greater than 90, no greater than 80, no greater than 70, no greater than 60, no greater than 50, no greater than 40, no greater than 30, no greater than 20, no greater than 10, no greater than 9, no greater than 8, no greater than 7, no greater than 6, no greater than 5, no greater than 4, no greater than 3, no greater than 2. Additionally, the ratio of $S:D_{FAE}$ can be within a range between and including any of the values described above, such as, for example, between 0.90 and 2.

In a particular aspect, the fluid agitating element 2 can translate along the support 24 at a rate of no less than 3 strokes per minute (SPM), no less than 5 SPM, no less than 10 SPM, no less than 20 SPM, no less than 30 SPM, no less than 40 SPM, no less than 50 SPM, no less than 75 SPM, no less than 100 SPM, no less than 150 SPM, no less than 200 SPM. In another aspect, the fluid agitating element 2 can translate along the support 24 at a rate of no greater than 1000 SPM, no greater than 900 SPM, no greater than 800 SPM, no greater than 700 SPM, no greater than 600 SPM, no greater than 500 SPM, no greater than 400 SPM, no greater than 300 SPM, no greater than 200 SPM, no greater than 100 SPM. The strokes per minute of the fluid agitating element 2 can also be within a range between and including any of the values described above.

In a particular embodiment, the support 24 can comprise a metal, a polymer, or a ceramic. The support 24 can further comprise a low friction layer 30 extending at least partially along the length of the column 28. The low friction layer 30 can comprise materials including, for example, a polymer, such as a polyketone, polyaramid, a polyimide, a polytherimide, a polyphenylene sulfide, a polyetherslfone, a polysulfone, a polypheylene sulfone, a polyamideimide, ultra high molecular weight polyethylene, a fluoropolymer, a polyamide, a polybenzimidazole, or any combination thereof.

In an example, the polymer material can include a polyketone, a polyaramid, a polyimide, a polyetherimide, a polyamideimide, a polyphenylene sulfide, a polyphenylene sulfone, a fluoropolymer, a polybenzimidazole, a derivation thereof, or a combination thereof. In a particular example, the thermoplastic material can include a polymer, such as a polyketone, a thermoplastic polyimide, a polyetherimide, a polyphenylene sulfide, a polyether sulfone, a polysulfone, a polyamideimide, a derivative thereof, or a combination thereof. In a further example, the material can include polyketone, such as polyether ether ketone (PEEK), polyether ketone, polyether ketone ketone, polyether ketone ether ketone, a derivative thereof, or a combination thereof. In an additional example, the thermoplastic polymer may be ultra high molecular weight polyethylene.

An example fluoropolymer includes fluorinated ethylene propylene (FEP), PTFE, polyvinylidene fluoride (PVDF), perfluoroalkoxy (PFA), a terpolymer of tetrafluoroethylene, hexafluoropropylene, and vinylidene fluoride (THV), polychlorotrifluoroethylene (PCTFE), ethylene tetrafluoroethylene copolymer (ETFE), ethylene chlorotrifluoroethylene copolymer (ECTFE), or any combination thereof. Fluoropolymers are used according to particular embodiments.

In a particular embodiment, the base 26 of the support 24 can be secured with the inner surface 36 of the vessel 34. Securement of the base 26 with the vessel 34 can occur by use of an adhesive, mechanical deformation, welding, or any other known method for securing two components. In a particular aspect, the base 26 can attach indirectly to the vessel 34 through a dish 78 which can engage with the inner surface 36 of the vessel 34.

The support 24 can further include a plurality of flutes 32 extending along an exterior surface 29 of the column 28. The flutes 32 can facilitate an enhanced fluidic bearing between the support 24 and the reciprocating fluid agitating element 2. In particular embodiments, the flutes 32 can be substantially parallel with the central axis 4 of the fluid agitating element 2. In other embodiments, the flutes 32 can be misaligned with the central axis 4 of the fluid agitating element 2 such that the flutes 32 form a substantially helical pattern along the exterior surface 29 of the column 28. In further embodiments, the flutes 32 can be oriented substantially perpendicular to the central axis 4 of the fluid agitating element 2.

The support 24 can include at least 1 flute per inch (FPI), at least 2 FPI, at least 3 FPI, at least 4 FPI, at least 5 FPI, at least 10 FPI, at least 20 FPI. The support can have no greater than 10,000 FPI, no greater than 5,000 FPI, no greater than 1,000 FPI, no greater than 500 FPI, no greater than 250 FPI, no greater than 100 FPI, no greater than 50 FPI. Additionally, the number of flutes per inch can be within a range between and including any of the values described above, such as, for example, 25 FPI.

Referring again to FIG. 1, the mixing assembly 1 can further include a plug 60 adapted to engage with the support 24. The plug 60 can be adapted to retain the fluid agitating element 2 on the support 24. The plug 60 can be adapted to form an interference fit with the support 24 such that the plug 60 can be removed therefrom. After the fluid agitating element 2 is engaged with the support 24, the plug 60 can be engaged with the support 24 such that the plug 60 prevents the fluid agitating element 2 from axially decoupling therefrom.

Referring to FIG. 24, the plug 60 can include a substantially hollow axial member 62 adapted to engage with the column 28 of the support 24. The plug 60 can further include a radial flange 64 extending from a distal end of the axial member 62. In particular embodiments, the plug 60 can also include an interference element 66 extending at least partly around the axial member 62. The interference element 66 can facilitate an enhanced engagement between the plug 60 and the support 24.

Figure 26:
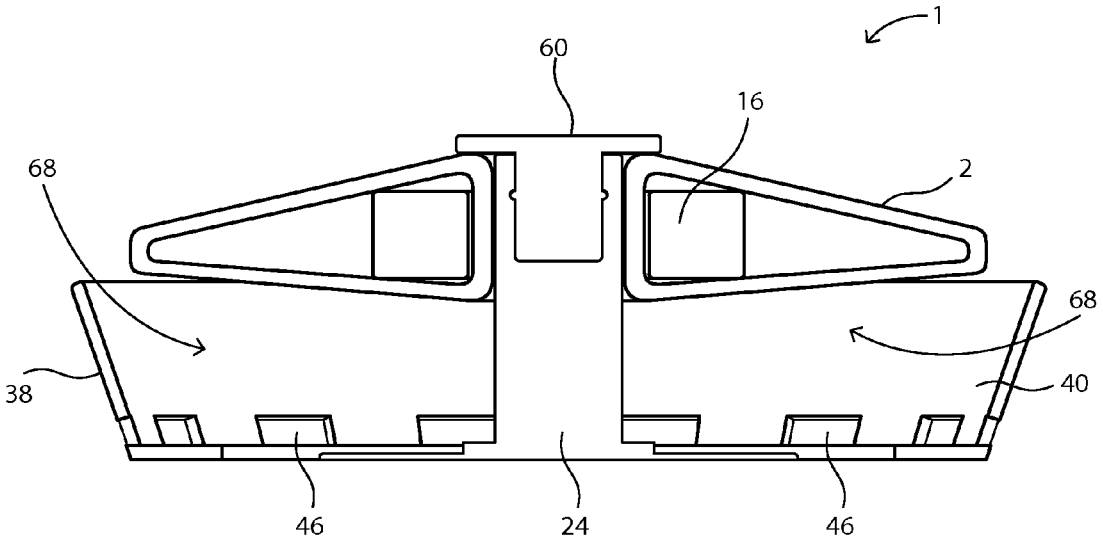
FIG. 26 includes a cross-sectional side view of a mixing assembly in accordance with an embodiment, wherein the mixing assembly is in a first position.
Figure 27:
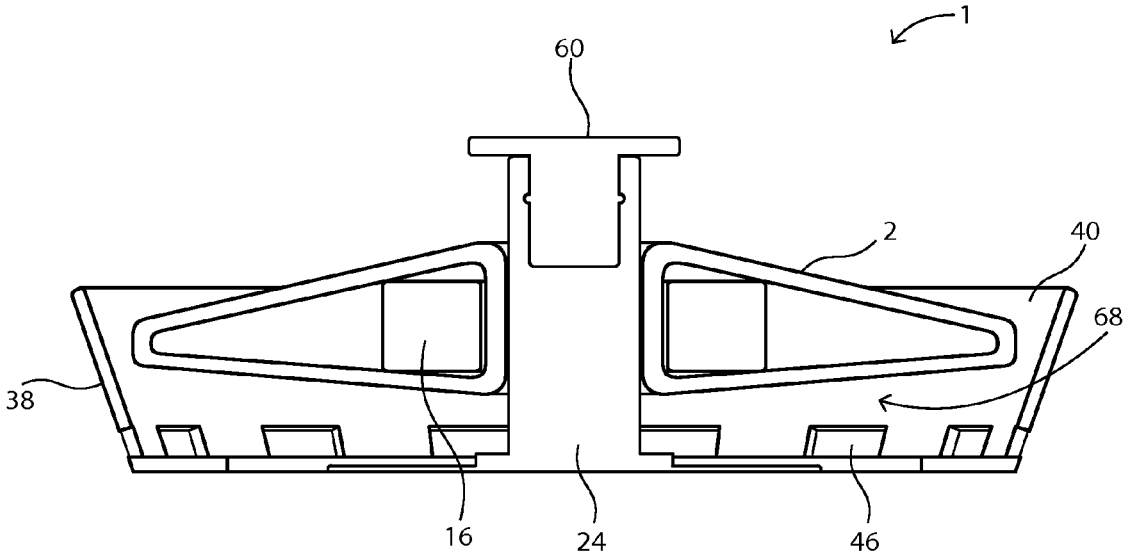
FIG. 27 includes a cross-sectional side view of a mixing assembly in accordance with an embodiment, wherein the mixing assembly is between the first position and a second position.
Figure 28:
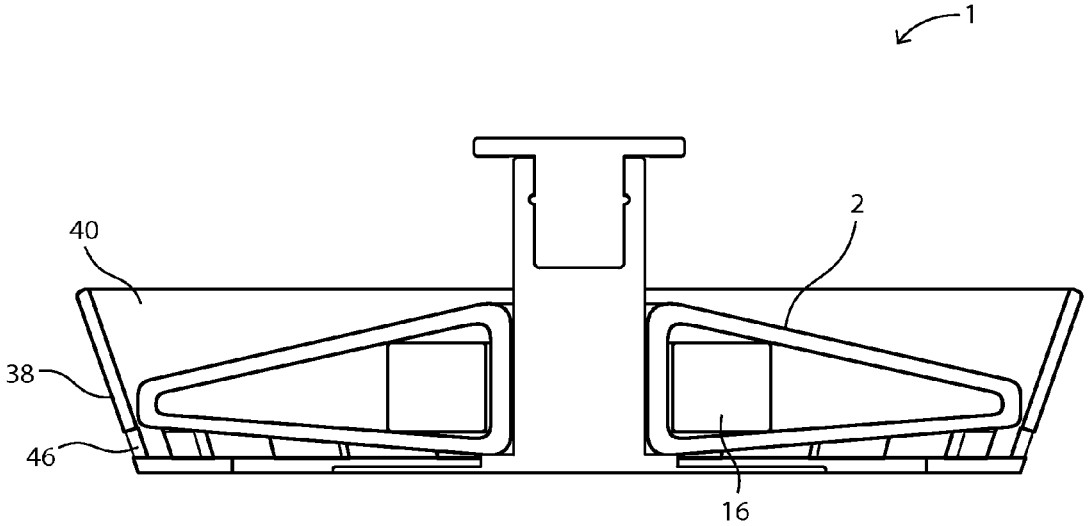
FIG. 28 includes a cross-sectional side view of a mixing assembly in accordance with an embodiment, wherein the mixing assembly is in a second position.

Referring now to FIG. 26 through FIG. 28, during operation the assembly 1 can reciprocate between a first position, as illustrated in FIG. 26, and a second position, as illustrated in FIG. 28. As discussed above, the total stroke length, S, between the first and second positions can be defined as the height of the column, $H_C$, minus the height of the fluid agitating element, $H_{FAE}$.

In particular embodiments, the radial clearance between the closest vertices (e.g., the closest points of contact) of the fluid agitating element 2 and the diffusing element 38 when the fluid agitating element 2 is in the first position can be at least 0.1 inches, at least 0.2 inches, at least 0.3 inches, at least 0.4 inches, at least 0.5 inches, at least 0.6 inches, at least 0.7 inches, at least 0.8 inches, at least 0.9 inches, at least 1.0 inches, at least 1.1 inches, at least 1.2 inches, at least 1.3 inches, at least 1.4 inches, at least 1.5 inches, at least 2.0 inches. In this regard, fluid is allowed to pass between the fluid agitating element 2 and the sidewall 40 of the diffusing element 38 and into a mixing cavity 68 defined generally by a volume located between the fluid agitating element 2 and the diffusing element 38.

As the fluid agitating element 2 translates towards the second position (illustrated in FIG. 28), the fluid agitating element 2 can pass through a middle position, as illustrated in FIG. 27. As shown in FIG. 28, in a particular embodiment, the apertures 46 of the diffusing element 38 can be positioned along the sidewall 40 such that the fluid agitating element 2 cannot pass thereover during translation from the first position to the second position. In this regard, each stroke, S, of the fluid agitating element 2 between the first and second positions can achieve a more optimal fluidic mixing characteristic.

Figure 29:
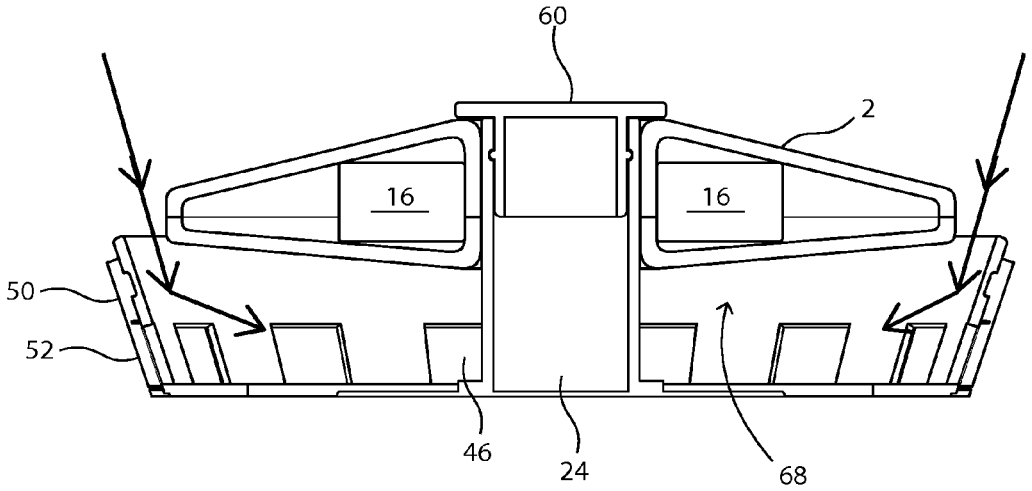
FIG. 29 includes a cross-sectional side view of a mixing assembly in accordance with an embodiment, wherein the mixing assembly is in a first position.

Referring now to FIG. 29, when the fluid agitating element 2 is in the first position fluid can flow into the mixing cavity 68. When the fluid agitating element 2 is in the first position, the gates 52 of the valve element 50 can substantially block the passage of fluid through the apertures 46 of the diffusing element 38. As fluid flows into the mixing cavity 68 the relative pressure gradient between the fluid inside the mixing cavity 68 and the fluid outside the mixing cavity 68 can decrease. As the fluid agitating element 2 begins to translate toward the second position, the relative fluid pressure in the mixing cavity 68 can increase in relation to the fluid outside the mixing cavity 68.

Figure 30:
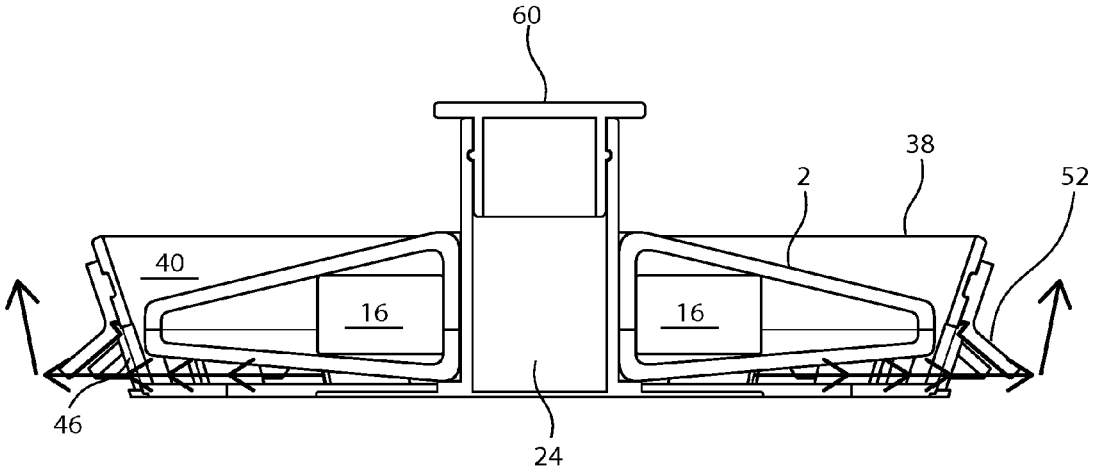
FIG. 30 includes a cross-sectional side view of a mixing assembly in accordance with an embodiment, wherein the mixing assembly is in a second position.

As the assembly 1 translates towards the second position, the relative fluidic pressure within the mixing cavity 68 can continue to increase. As illustrated in FIG. 30, as the pressure of the fluid within the mixing cavity 68 compared to the pressure of the fluid outside of the mixing cavity 68 reaches a critical point, the gates 52 of the valve element 50 can open. This in turn can cause fluid to eject from the mixing cavity 68. In a particular aspect, the affect of increasing the pressure within the mixing cavity 68 during translation of the fluid agitating element 2 between the first and second positions in order to eject the fluid from the mixing cavity 68 can be referred to generally as "pumping."

After the fluid agitating element 2 reaches the end of the first stroke, S, as defined by the fluid agitating element 2 reaching the second position, the fluid agitating element can again return to the first position, illustrated in FIG. 29. As the fluid agitating element 2 moves from the second to first positions a relatively negative pressure can be generated in the mixing cavity 68. As a result, fluid from outside the mixing cavity 68 can flow into the mixing cavity 68. At this stage, the above described process can repeat. The combination of a first stroke from the first position to the second position with a second stroke from the second position to the first position can generally be referred to herein as "reciprocation." This reciprocation can allow the mixing assembly 1 to efficiently "pump" fluid within the vessel 34.

Figure 31:
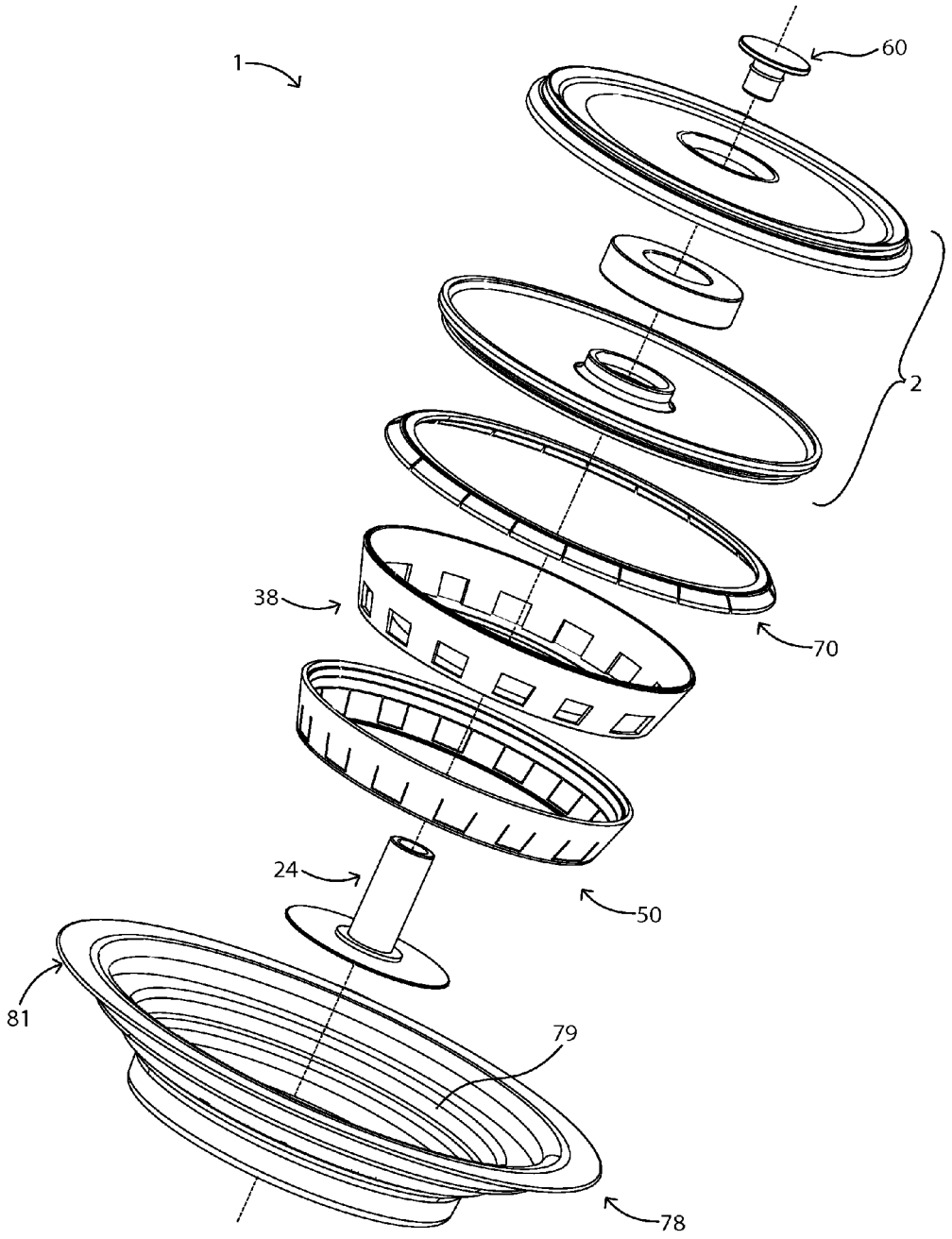
FIG. 31 includes an exploded perspective view of a mixing assembly in accordance with an embodiment.
Figure 32:
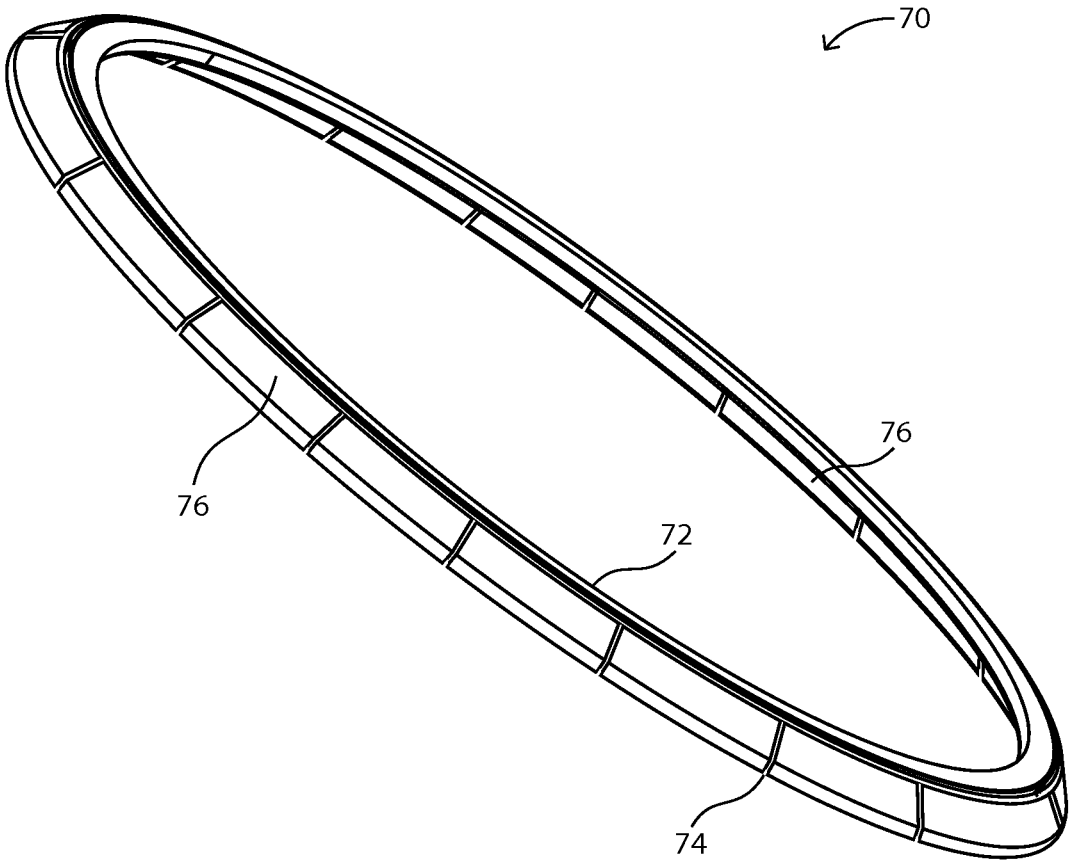
FIG. 32 includes a perspective view of a second valve element in accordance with an embodiment.

Referring to FIG. 31 and FIG. 32, the assembly 1 can further include a second valve element 70 which can be engaged with the fluid agitating element 2. The second valve element 70 can be a generally annular ring 72 and can include a plurality of joints 74 defining segments 76 therein. These joints 74 can extend at least partially through the ring 72 and can facilitate greater ring 72 flexibility. In particular embodiments, the second valve element 70 can be a monolithic piece.

In particular embodiments, the second valve element 70 can be engaged to an outer edge of the fluid agitating element 2. In this regard, the second valve element 70 can facilitate at least a partial fluidic seal between the fluid agitating element 2 and the diffusing element 38. The second valve element 70 can in turn increase the pressure within the mixing cavity 68 during translation of the fluid agitating element from the first position to the second position. Specifically, by providing an increased seal between the fluid agitating element 2 and the diffusing element 38, the second valve element 70 can decrease the volume of fluid which passes through the radial gap between the diffusing element 38 and the fluid agitating element 2, which can increase the fluidic pressure within the mixing cavity 68. Moreover, the second valve element 70 can increase the "pumping" action within the fluid by generating greater pressure gradients and more turbulent fluid flow within the vessel.

In particular embodiments, the second valve element 70 can comprise a substantially flexible material such as a polymer, a thermoplastic material, an elastomer, a silicone based material, or any combination thereof. In other embodiments, the second valve element 70 can include multiple materials. For example, the segments 76 can comprise a first material while the remainder of the second valve element 70 comprises a second material. In this regard, the segments 76 can have greater flexibility than the remainder of the second valve element 70. In a particular aspect, the second valve element 70 can have a greater flexibility than the fluid agitating element 2.

As illustrated in FIG. 31, the mixing assembly 1 can include a dish 78. The dish 78 can support the mixing assembly 1. Additionally, the dish 78 can form an intermediary layer between the mixing assembly 1 and a vessel into which the mixing assembly 1 is positioned. The dish 78 can have any shape. For example, the dish 78 can be planar, frustoconical, tapered, beveled, pyramidal, rectilinear, or any combination thereof.

Moreover, the dish 78 can further include a sidewall 79. The mixing assembly 1 can be positioned within the dish 78 such that fluid ejecting from the apertures 46 of the diffusing element 38 can collide with the sidewall 79. In a particular aspect, the collision of the fluid into the sidewall 79 can increase the mixing efficiency of the fluid.

In a particular embodiment, the dish 78 can be adapted to engage with the inside wall of a preexisting vessel. In this regard, the dish 78 can be affixed to the inner surface of the vessel to prevent the dish from disengaging therefrom. The dish 78 can have a diameter less than that of the vessel. In another embodiment, the dish 78 can extend outward from the vessel such that an outer surface of the dish 78 is visible from the outside of the vessel. In this embodiment, the dish 78 can have an engagement feature 81 adapted to engage with the vessel and prevent the dish 78 from disengaging therefrom. The engagement feature 81 can include a lip adapted to engage with the vessel 34. In a further embodiment, the dish 78 can extend into the vessel.

In a particular embodiment, the vessel can have flexible walls. In another embodiment, the vessel can have rigid walls. In a particular embodiment, the support 24 and/or diffusing element 38 can be affixed directly to the wall of the vessel. In another embodiment, the support 24 and/or diffusing element 38 can be affixed to the dish 78.

Figure 33:
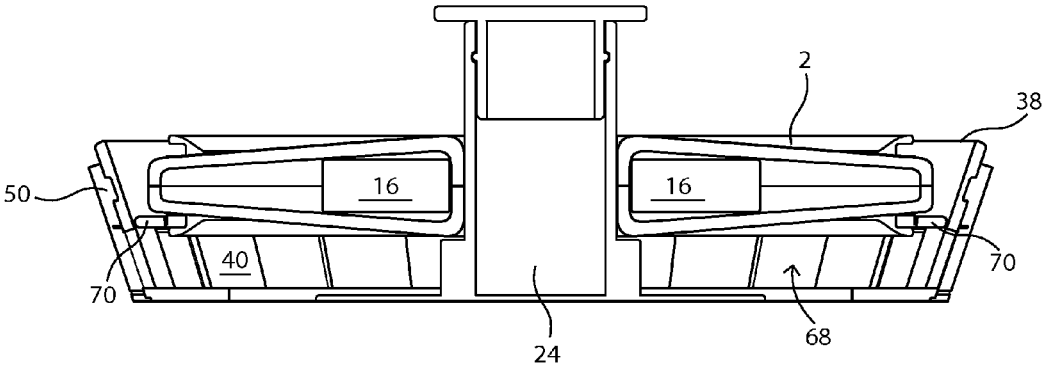
FIG. 33 includes a cross-sectional side view of a mixing assembly in accordance with an embodiment, wherein the mixing assembly is in a second position.
Figure 34:
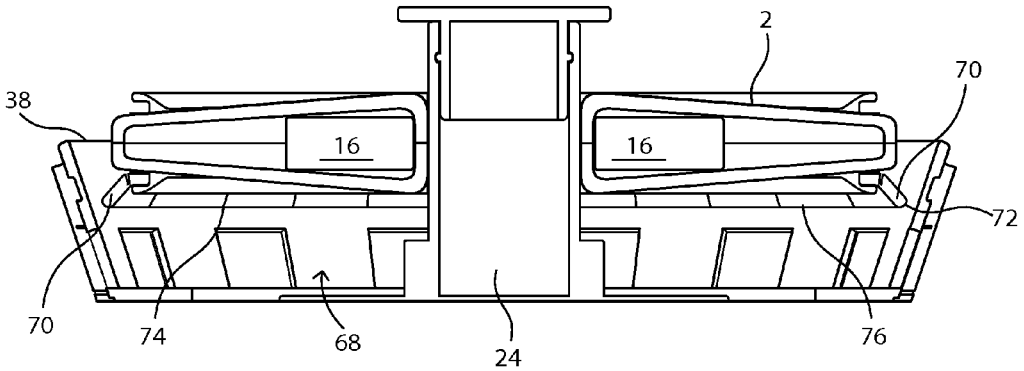
FIG. 34 includes a cross-sectional side view of a mixing assembly in accordance with an embodiment, wherein the mixing assembly is between the second position and a first position.
Figure 35:
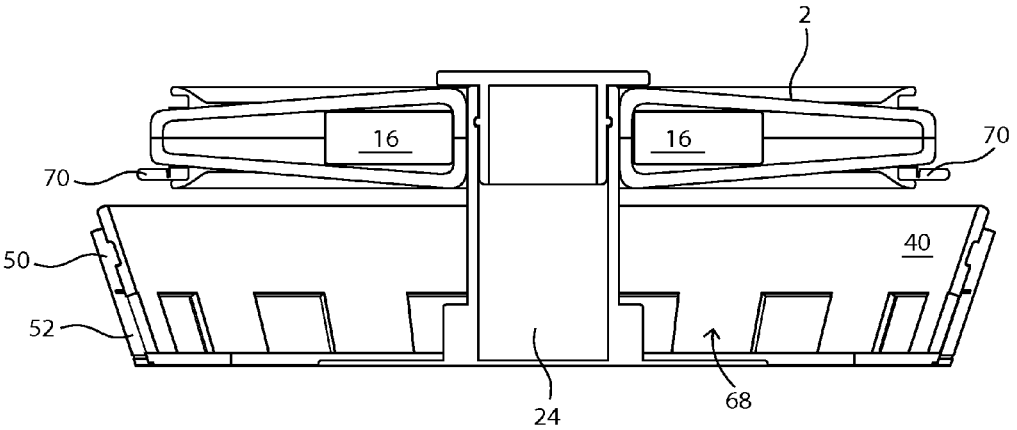
FIG. 35 includes a cross-sectional side view of a mixing assembly in accordance with an embodiment, wherein the mixing assembly is in a first position.
Figure 36:
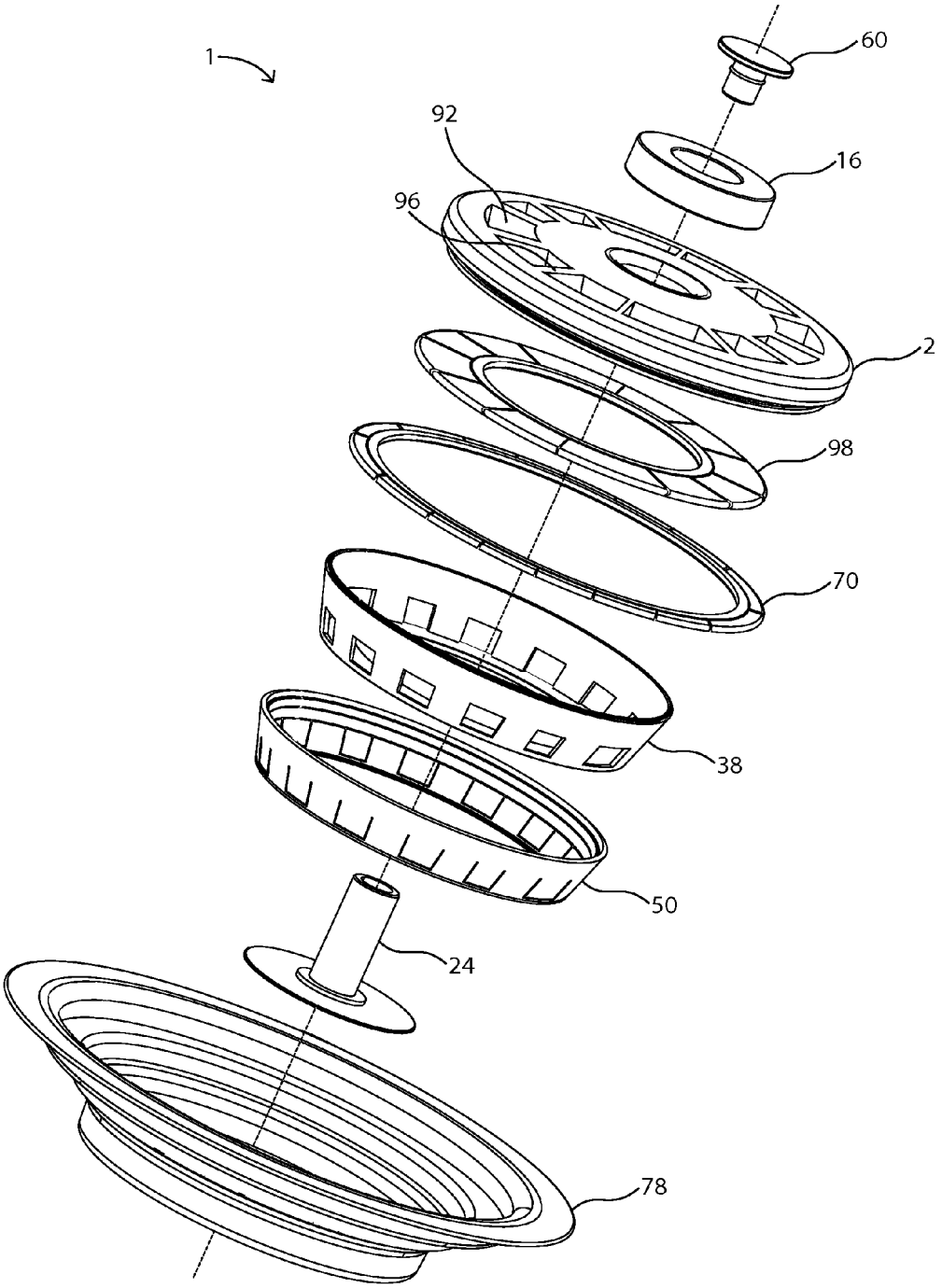
FIG. 36 includes an exploded perspective view of a mixing assembly in accordance with an embodiment.
Figure 37:
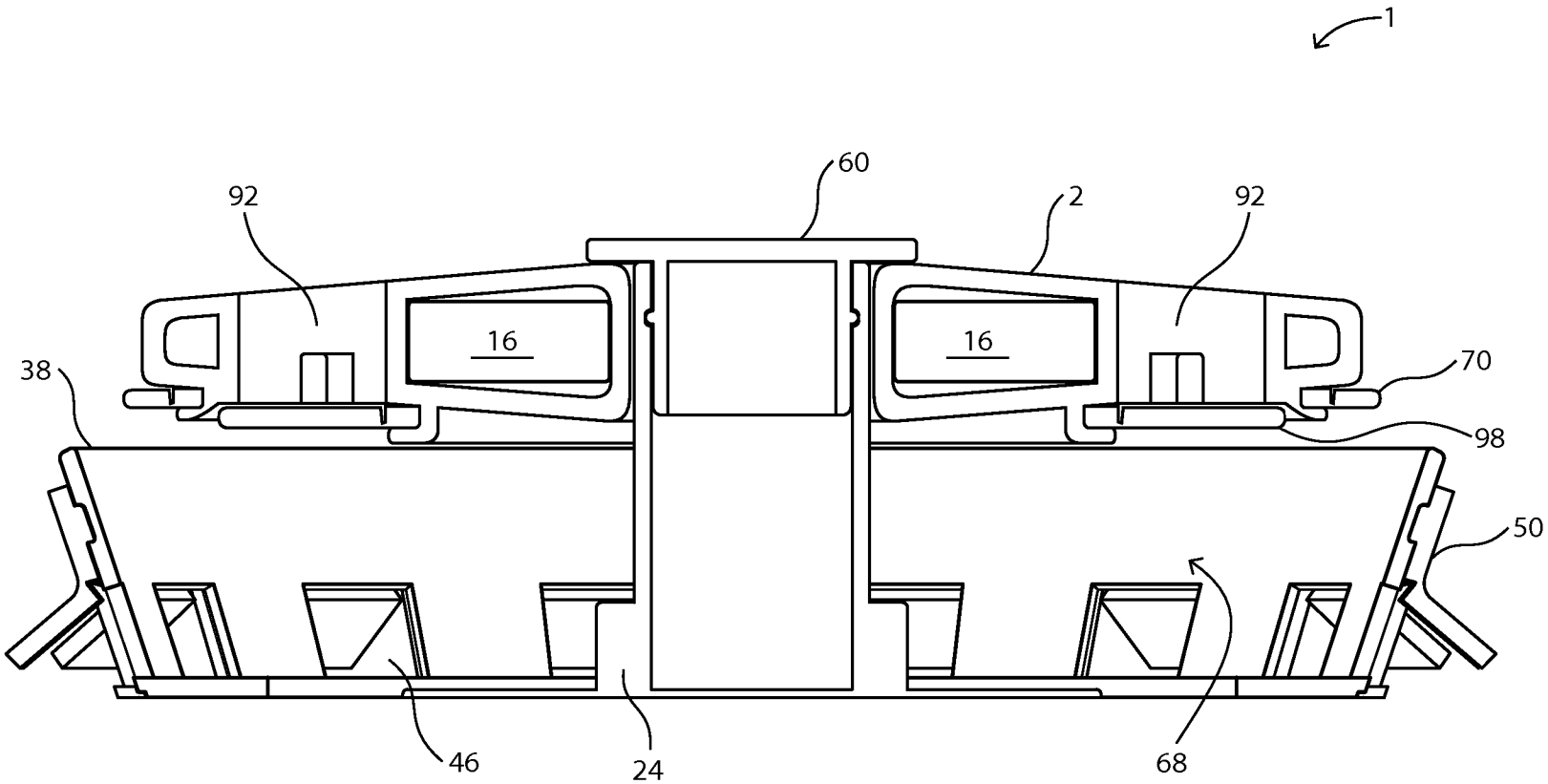
FIG. 37 includes a cross-sectional side view of a mixing assembly in accordance with an embodiment, wherein the mixing assembly is in a first position.
Figure 38:
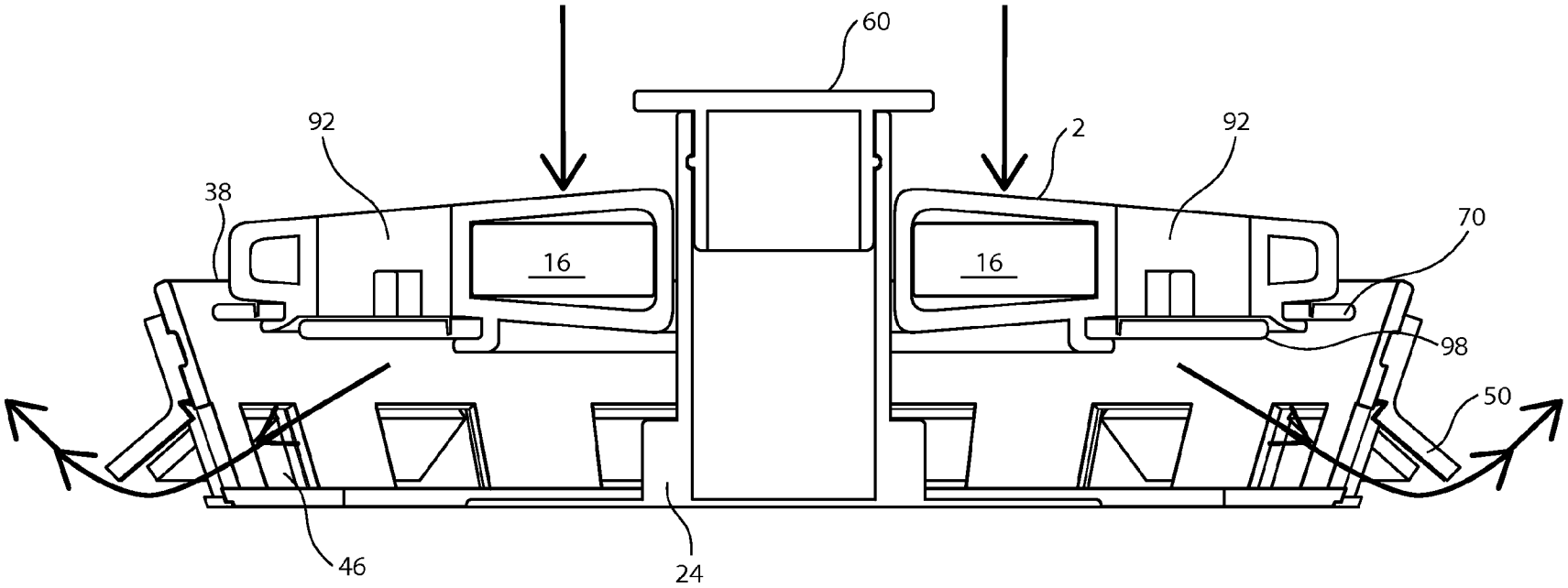
FIG. 38 includes a cross-sectional side view of a mixing assembly in accordance with an embodiment, wherein the mixing assembly is between the first position and the second position.
Figure 39:
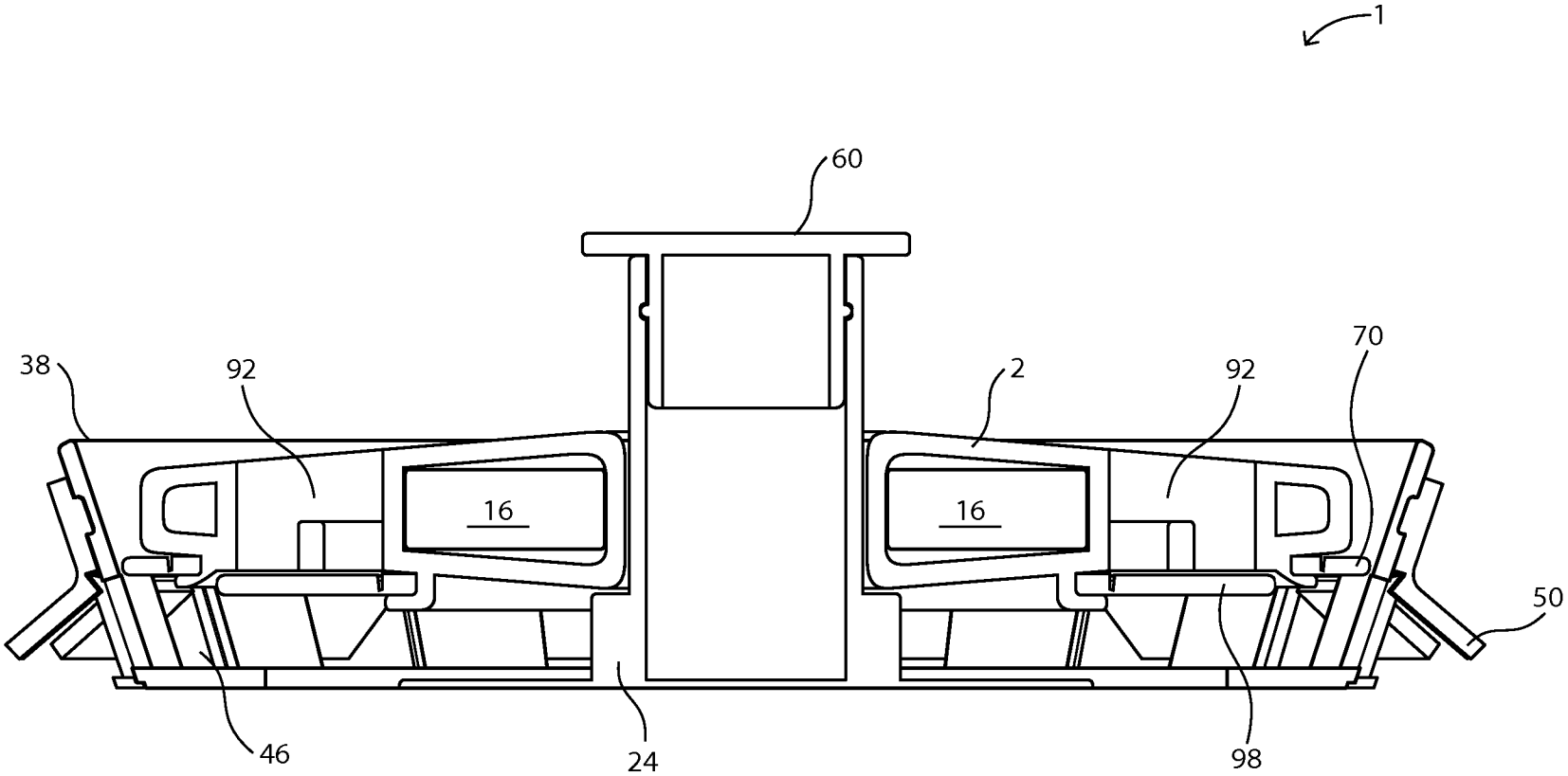
FIG. 39 includes a cross-sectional side view of a mixing assembly in accordance with an embodiment, wherein the mixing assembly is in a second position.

Referring now to FIG. 33 to FIG. 35, the fluid agitating element 2 can be adapted to move between a first position, as illustrated in FIG. 35, and a second position, as illustrated in FIG. 33. As the fluid agitating element 2 moves from the first position to the second position, the second valve element 70 can sealingly engage with the diffusing element 38. An enhanced fluidic seal can form between the fluid agitating element 2 and the diffusing element 38. In this regard, the pressure gradient generated between the mixing cavity 68 and the external fluid can increase. As the pressure gradient between the mixing cavity 68 and the external fluid increases, mixing efficiency can also increase.

As illustrated in FIG. 36 through FIG. 39, in particular embodiments, the fluid agitating element 2 can include a plurality of apertures 92 extending between the first and second major surfaces 6, 8. The apertures 92 can extend around the central axis 4 of the fluid agitating element 2 and can provide an opening for fluid to flow vertically through the fluid agitating element 2 and into the mixing cavity 68.

In other embodiments, the apertures 92 can be formed from a continuous toroidal opening concentric with the central axis 4. A plurality of support members 96 can extend radially across the toroidal opening to create separate apertures 92.

The apertures 92 can be formed at any radial position of the fluid agitating element 2 and comprise any shape. For example, a center line 94 of the apertures 92 can have a diameter, $D_A$, as measured parallel with the fluid agitating element 2. The length of $D_A$ can be less than the diameter of the fluid agitating element, $D_{FAE}$. A ratio of $D_A$:$D_{FAE}$ can be less than 0.9, less than 0.8, less than 0.7, less than 0.6, less than 0.5, less than 0.4, less than 0.3, less than 0.2. The ratio of $D_A$:$D_{FAE}$ can be greater than 0.1, greater than 0.2, greater than 0.3, greater than 0.4, greater than 0.5, greater than 0.6, greater than 0.7, greater than 0.8. Additionally, the ratio of $D_A$:$D_{FAE}$ can be in a range between and including any of the above described values, such as, for example, between 0.5 and 0.8.

In particular embodiments, the fluid agitating element 2 can have a total surface area, $SA_{FAE}$. Moreover, the apertures 92 can form a total cutout area, $CA_A$, within the fluid agitating element 2. A ratio of $SA_{FAE}$:$CA_A$ can be at least 1.01, at least 1.5, at least 2.0, at least 2.5, at least 3.0, at least 3.5, at least 4.0, at least 5.0, at least 10.0, at least 20.0. The ratio of $SA_{FAE}$:$CA_A$ can be no greater than 1000, no greater than 900, no greater than 800, no greater than 700, no greater than 600, no greater than 500, no greater than 400, no greater than 300, no greater than 200, no greater than 100, no greater than 50, no greater than 25, no greater than 10. Additionally, the ratio of $SA_{FAE}$:$CA_A$ can be in a range between and including any of the above described values, such as, for example, between 1.5 and 10.0.

Each of the support members 96 of the fluid agitating element 2 can be oriented at an angle relative to the central axis 4. For example, the support members 96 can have a relative angle of 5 degrees, 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, 80 degrees, 85 degrees, or 90 degrees. Additionally, the angle of the support members 96 can be at any angle between and including the values described above. As the angle of the support members 96 increases, the volume of fluid permitted to pass through the apertures 92 can decrease.

Figure 40:
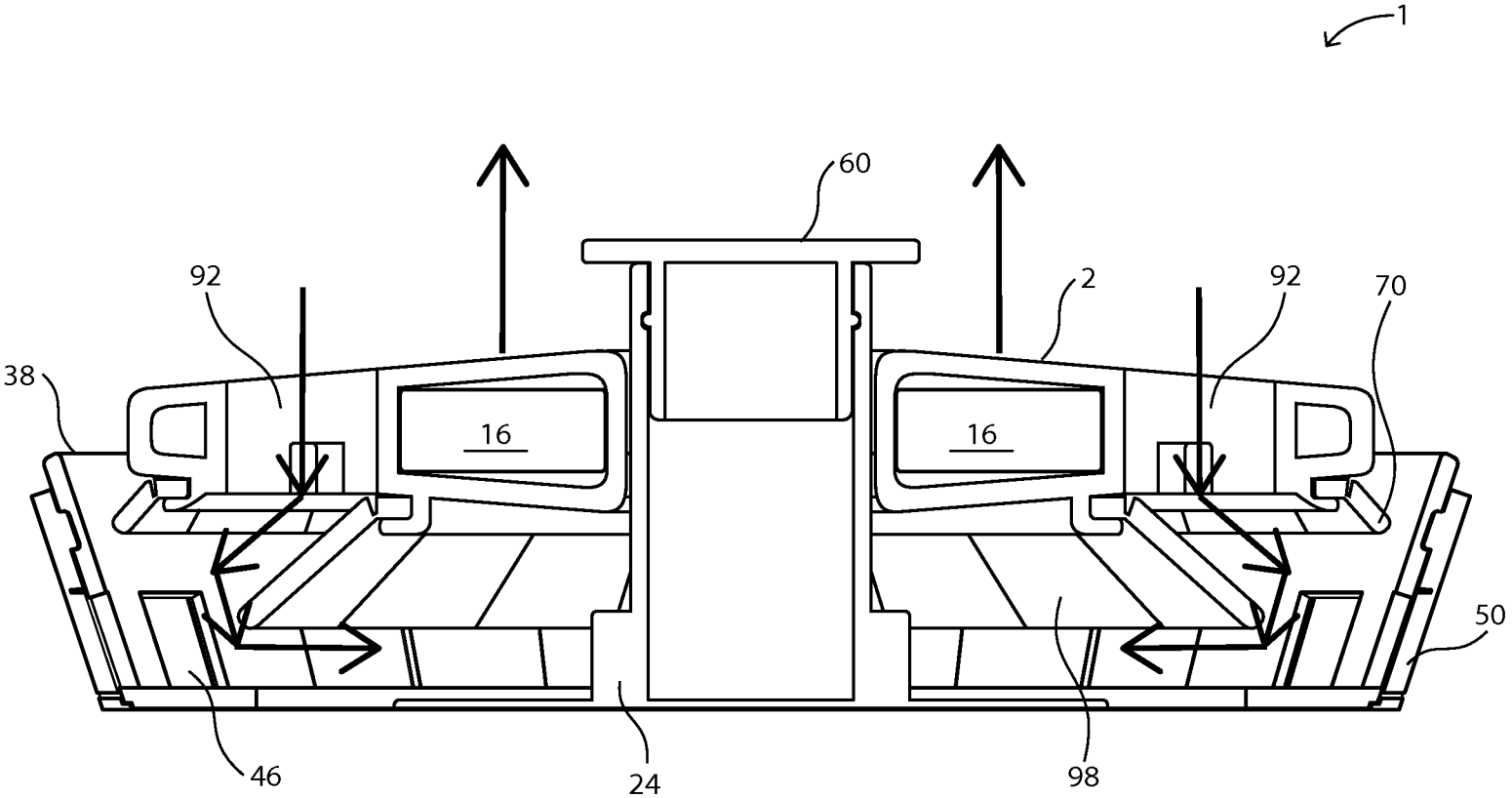
FIG. 40 includes a cross-sectional side view of a mixing assembly in accordance with an embodiment, wherein the mixing assembly is between the second position and the first position.

A third valve element 98 can be positioned along the apertures 92 of the fluid agitating element 2. In particular, the third valve element 98 can be positioned substantially parallel with the second major surface 8 of the fluid agitating element 2. In this regard, the third valve element 98 can facilitate at least a partial fluidic seal of the apertures 92. As the fluid agitating element 2 translates from the first position, illustrated in FIG. 37, towards the diffusing element 38, illustrated in FIG. 38, to the second position, illustrated in FIG. 39, the third valve element 98 can prevent fluid flow through the apertures 92. Conversely, as the fluid agitating element 2 translates away from the diffusing element 38 to the first position, as illustrated in FIG. 40, the third valve assembly 98 can permit fluid flow through the apertures 92 and into the mixing cavity 68. Accordingly, the third valve element 98 can enhance fluidic mixing efficiency and increase the flow of fluid within the vessel.

In particular embodiments, the third valve element 98 can comprise a substantially flexible material such as a polymer, a thermoplastic material, an elastomer, a silicone based material, or any combination thereof. In other embodiments, the third valve element 98 can be formed from multiple materials. In a particular aspect, the third valve element 98 can have a greater flexibility than the fluid agitating element 2.

The mixing assembly 1 can include the first valve element 50, the second valve element 70, the third valve element 98, and any combination thereof. For example, in certain embodiments, the mixing assembly 1 can include the first and second valve elements 50, 70. In other embodiments, the mixing assembly 1 can include the first valve element 50 and the third valve element 98. In yet other embodiments, the mixing assembly 1 can include the second valve element 70 and the third valve element 98.

Figure 41:
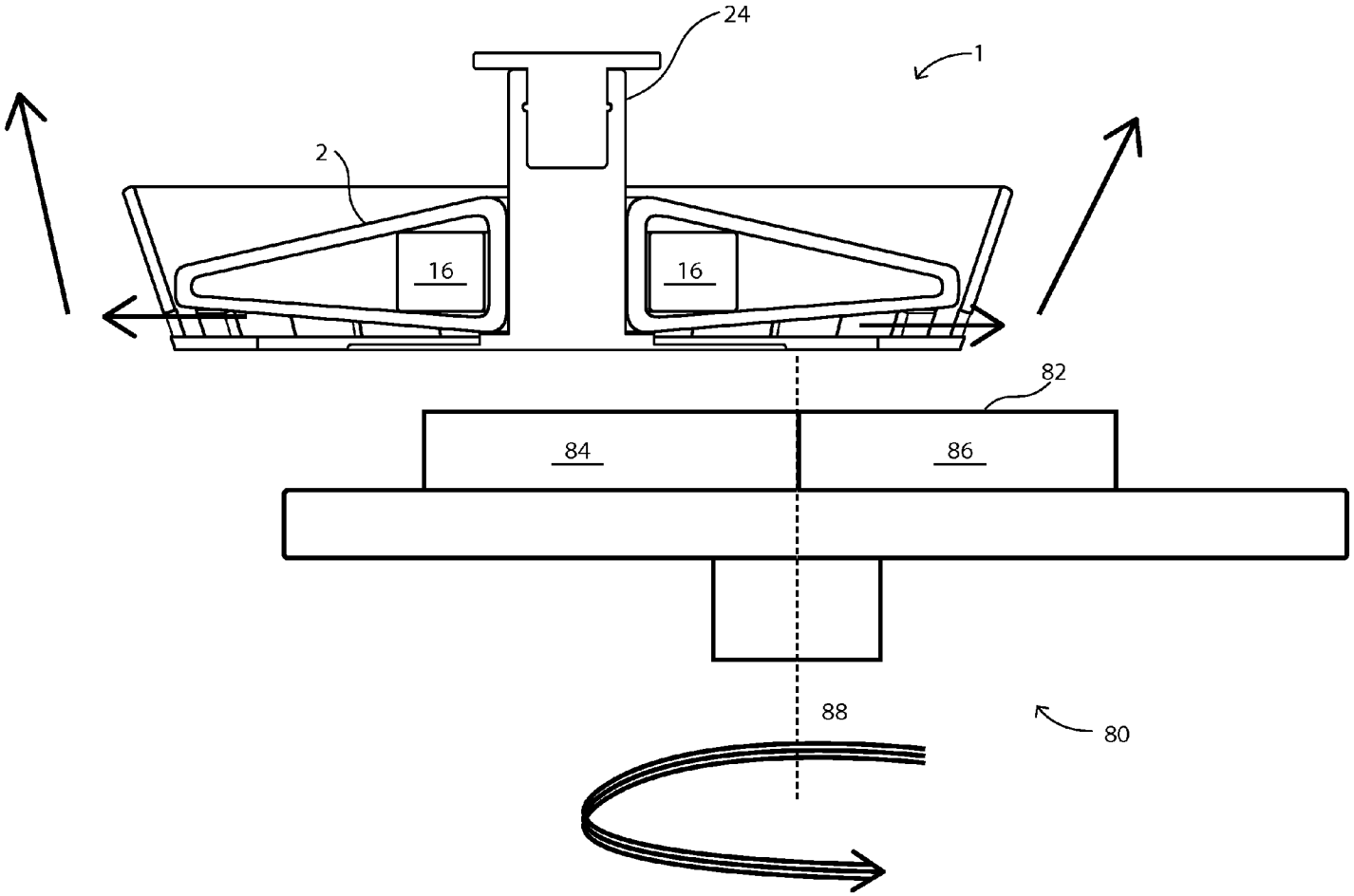
FIG. 41 includes a cross-sectional side view of a mixing assembly in accordance with an embodiment, wherein a rotatable magnetic drive is magnetically coupled to the magnetic member and wherein the mixing assembly is in a second position.
Figure 42:
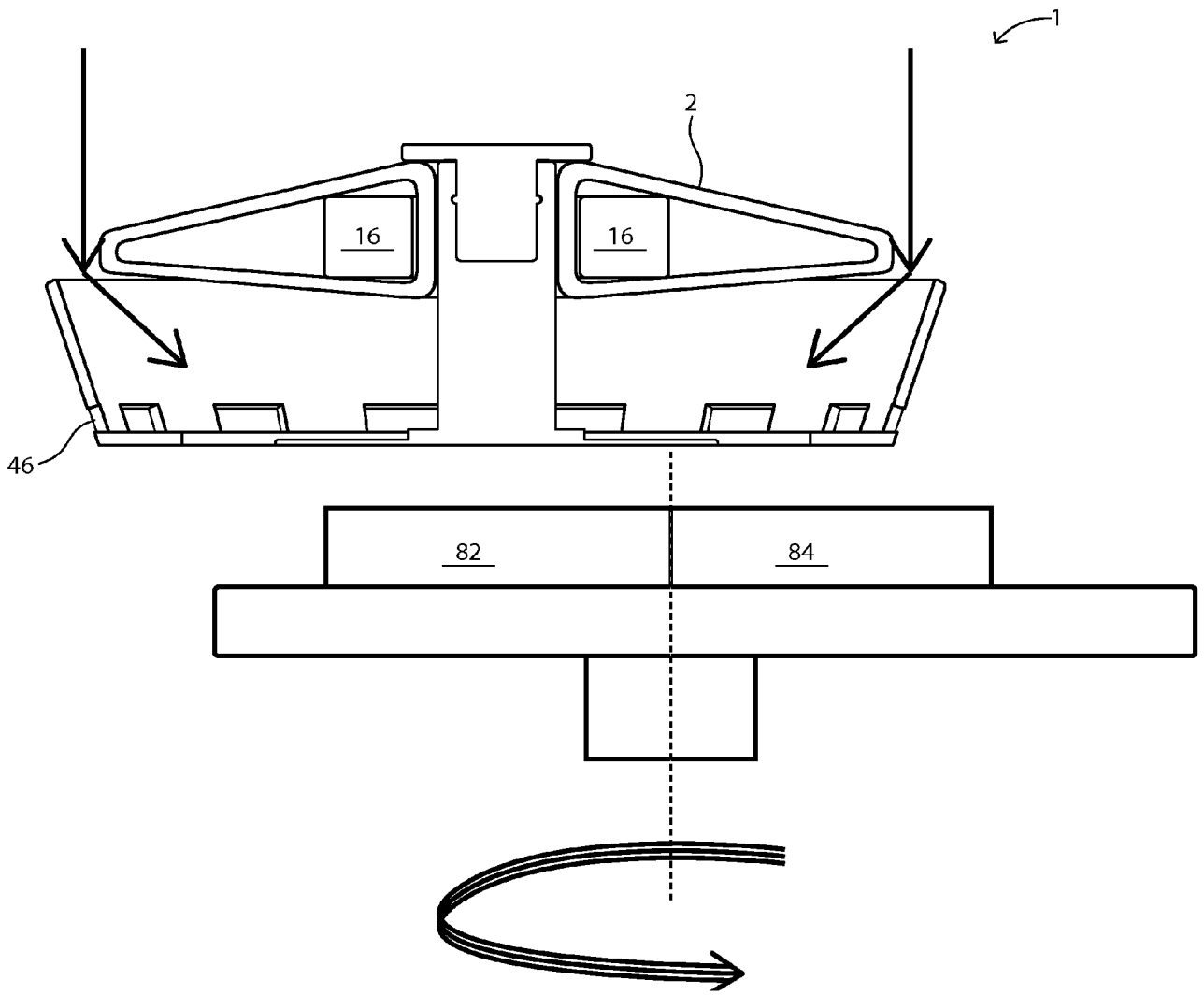
FIG. 42 includes a cross-sectional side view of a mixing assembly in accordance with an embodiment, wherein a rotatable magnetic drive is magnetically coupled to the magnetic member and wherein the mixing assembly is in a first position.

Referring to FIG. 41 and FIG. 42, the mixing assembly 1 can be engaged with a drive device 80 which can urge the fluid agitating element 2 to reciprocate along the support 24.

In a particular embodiment, the drive device 80 can be a rotatable magnetic drive 82. The rotatable magnetic drive 82 can be bipolar, containing a positive pole 84 and a negative pole 86. The positive and negative poles 84, 86 of the rotatable magnetic drive 82 can be positioned in a plane substantially perpendicular to the central axis 17 of the magnetic member 16. In this regard, the rotatable magnetic drive 82 can alternately attract and repel the magnetic member 16 disposed within the fluid agitating element 2, depending on the arrangement of the poles 84, 86 at a given point in time.

As illustrated in FIG. 41 and FIG. 42, the rotatable magnetic drive 82 can have a central axis of rotation 88 that is perpendicularly offset from the central axis 17 of the magnetic member 16. In this regard, the magnetic member 16 can be exposed to either one of the positive or negative poles 84, 86 at a single point in time. For example, as the rotatable magnetic drive 82 rotates, the fluid agitating element 2 can reciprocate along the support 24.

In particular embodiments, as the positive pole 84 of the rotatable magnetic drive 82 engages with the magnetic member 16, the fluid agitating element 2 can be attracted to the rotatable magnetic drive 82, thus urging the fluid agitating element 2 to the second position. Conversely, as the negative pole 86 of the rotatable magnetic drive 82 engages with the magnetic member 16, the fluid agitating element 2 can be repelled away from the rotatable magnetic drive 82, thus urging the fluid agitating element 2 to the first position.

In another embodiment, as the positive pole 84 of the rotatable magnetic drive 82 engages with the magnetic member 16, the fluid agitating element 2 can be repelled from the rotatable magnetic drive 82, thus urging the fluid agitating element 2 to the first position. Conversely, as the negative pole 86 of the rotatable magnetic drive 82 engages with the magnetic member 16, the fluid agitating element 2 can be attracted to the rotatable magnetic drive 82, thus urging the fluid agitating element 2 to the second position.

Figure 43:
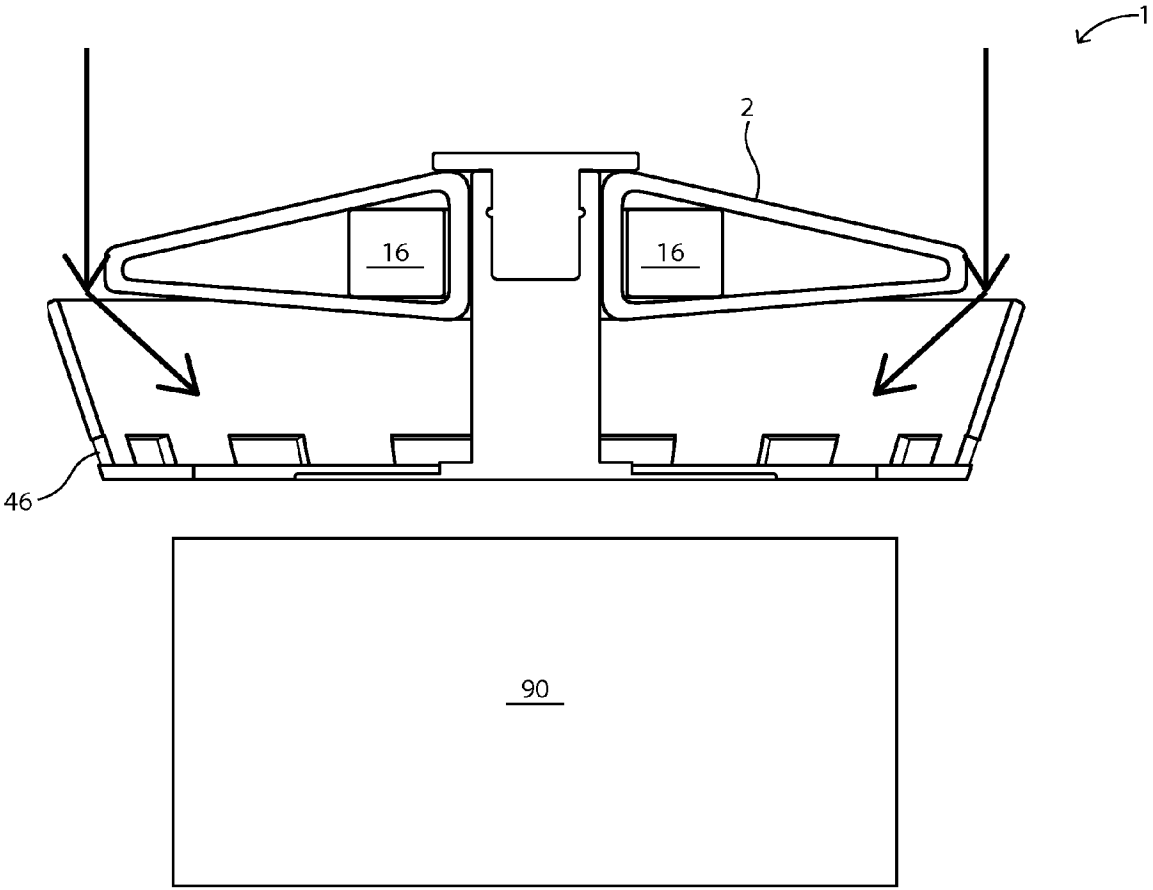
FIG. 43 includes a cross-sectional side view of a mixing assembly in accordance with an embodiment, wherein a rotatable magnetic drive is coupled to an electromagnet and wherein the mixing assembly is in a first position. Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

In another embodiment illustrated in FIG. 43, the drive device 80 can be an electromagnet 90. As referred to herein, an "electromagnet" can refer to any magnet in which the magnetic field is produced by the flow of electric current.

In a particular embodiment, the electromagnet 90 can be positioned generally below the mixing assembly 1. In another embodiment, the electromagnet 90 can be positioned above the mixing assembly 1. In yet a further embodiment, the electromagnet 90 can be positioned at any position where it can couple with and reciprocate the fluid agitating element 2. It can be understood that the electromagnet 90 can be positioned either within the vessel or along the exterior of the vessel 34.

In a particular embodiment, the electromagnet 90 can alternate between a positive and negative magnetic force. In this regard, the fluid agitating element 2 will be urged to the first position when the force is either positive or negative, and will be urged to the second position when the force is the opposite of positive or negative.

In another embodiment, the electromagnet 90 can alternate between engagement and disengagement with the magnetic member 16. In a particular embodiment, the fluid agitating element 2 can have a lower density than the fluid to be mixed, thus making it more buoyant than the fluid. In this regard, the electromagnet 90 can attract the magnetic member 16 when in the engaged orientation. When the electromagnet 90 is disengaged from the magnetic member 16 the fluid agitating element 2 can translate to the first position. When the electromagnet 90 is engaged with the magnetic member 16 the fluid agitating element 2 can translate to the second position.

In a further embodiment, the fluid agitating element 2 can have a greater density than the fluid to be mixed. In this regard, the electromagnet 90 can repel the magnetic member 16 when in the engaged orientation. When the electromagnet 90 is engaged with the magnetic member 16 the fluid agitating element 2 can translate to the first position. When the electromagnet 90 is disengaged from the magnetic member 16 the fluid agitating element 2 can translate to the first position.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

Many different aspects and embodiments are possible. Some of those aspects and embodiments are described below. After reading this specification, skilled artisans will appreciate that those aspects and embodiments are only illustrative and do not limit the scope of the present invention. Embodiments may be in accordance with any one or more of the items as listed below.

Item 1. A mixing assembly, comprising:
a fluid agitating element; and
a magnetic member engaged with the fluid agitating element;
wherein the mixing assembly is adapted to reciprocate within a fluid.

Item 2. A mixing assembly, comprising:
a fluid agitating element; and
a magnetic member engaged with the fluid agitating element;
wherein the mixing assembly is adapted to generate a plurality of vortex rings within
a fluid in response to a linear oscillation of the magnetic member.

Item 3. A mixing assembly, comprising:
a fluid agitating element; and
a magnetic member engaged with the fluid agitating element, the magnetic member
adapted to magnetically couple to a drive device, wherein the drive device comprises
a rotatable magnetic drive or an electromagnetic drive;
wherein the mixing assembly is adapted to generate a pumping action in a fluid in response to actuation of the drive device.

Item 4. The mixing assembly according to any one of the preceding items, further comprising a diffusing element.

Item 5. The mixing assembly according to item 4, wherein the diffusing element comprises an annular band.

Item 6. The mixing assembly according to any one of items 4-5, wherein the diffusing element comprises an aperture.

Item 7. The mixing assembly according to any one of items 4-6, wherein the diffusing element comprises a plurality of apertures.

Item 8. The mixing assembly according to item 7, wherein the plurality of apertures have substantially the same size.

Item 9. The mixing assembly according to any one of items 7-8, wherein the plurality of apertures have substantially the same shape.

Item 10. The mixing assembly according to item 9, wherein the apertures have a substantially rectangular shape.

Item 11. The mixing assembly according to any one of items 7-10, wherein the diffusing element has an inner surface area, $A_{DE}$, wherein the apertures define an area, $A_P$, and wherein $A_{DE}$ is at least 1.1 $A_P$, at least 1.2 $A_P$, at least 1.3 $A_P$, at least 1.4 $A_P$, at least 1.5 $A_P$, at least 1.6 $A_P$, at least 1.7 $A_P$, at least 1.8 $A_P$, at least 1.9 $A_P$, at least 2.0 $A_P$, at least 2.1 $A_P$, at least 2.2 $A_P$, at least 2.3 $A_P$, at least 2.4 $A_P$, at least 2.5 $A_P$, at least 2.6 $A_P$, at least 2.7 $A_P$, at least $2._8$ AP, at least $2._9$ AP, at least 3.0 $A_P$, at least 3.5 $A_P$, at least 4.0 $A_P$, at least 4.5 $A_P$.

Item 12. The mixing assembly according to item 11, wherein $A_{DE}$ is no greater than 10 $A_P$, no greater than 9 $A_P$, no greater than 8 $A_P$, no greater than 7 $A_P$, no greater than 6 $A_P$, no greater than 5 $A_P$, no greater than 4 $A_P$, no greater than 3 $A_P$.

Item 13. The mixing assembly according to any one of items 4-12, wherein the diffusing element further comprises a radial flange.

Item 14. The mixing assembly according to item 13, wherein the radial flange extends inward.

Item 15. The mixing assembly according to any one of items 4-14, wherein the diffusing element is frustoconical.

Item 16. The mixing assembly according to any one of items 4-15, wherein the diffusing element has a minimum circumference, $C_D$, wherein the fluid agitating element has a maximum circumference, $C_{FAE}$, and wherein $C_D$ is greater than $C_{FAE}$.

Item 17. The mixing assembly according to item 16, wherein $C_D$ is 1.01 $C_{FAE}$, 1.05 $C_{FAE}$, 1.10 $C_{FAE}$, 1.15 $C_{FAE}$, 1.20 $C_{FAE}$, 1.25 $C_{FAE}$, 1.30 $C_{FAE}$.

Item 18. The mixing assembly according to any one of items 15-17, wherein the diffusing element has a maximum circumference, $C_{DMAX}$, and wherein $C_{DMAX}$ is at least 1.01 $C_D$, at least 1.05 $C_D$, at least 1.10 $C_D$, at least 1.15 $C_D$, at least 1.20 $C_D$.

Item 19. The mixing assembly according to items 18, wherein $C_{DMAX}$ is no greater than 1.50 $C_D$, no greater than 1.45 $C_D$, no greater than 1.40 $C_D$, no greater than 1.35 $C_D$, no greater than 1.30 $C_D$, no greater than 1.25 $C_D$.

Item 20. The mixing assembly according to any one of items 16-19, wherein the diffusing element has a height, $H_D$, and wherein $H_D$ is less than 0.50 $C_D$, less than 0.45 $C_D$, less than 0.40 $C_D$, less than 0.35 $C_D$, less than 0.30 $C_D$, less than 0.25 $C_D$, less than 0.20 $C_D$, less than 0.15 $C_D$, less than 0.10 $C_D$.

Item 21. The mixing assembly according to item 20, wherein $H_D$ is greater than 1.005 $C_D$, greater than 1.010 $C_D$, greater than 1.015 $C_D$, greater than 1.020 $C_D$, greater than 1.025 $C_D$, greater than 1.030 $C_D$.

Item 22. The mixing assembly according to any one of items 4-21, wherein the diffusing element is engaged to a wall of a vessel.

Item 23. The mixing assembly according to any one of items 13-21, wherein the radial flange is engaged to a wall of a vessel.

Item 24. The missing assembly according to any one of items 4-21, wherein the diffusing element is engaged to a stir dish.

Item 25. The mixing assembly according to any one of items 4-24, wherein the diffusing element comprises a metal.

Item 26. The mixing assembly according to any one of items 4-24, wherein the diffusing element comprises a polymer.

Item 27. The mixing assembly according to item 26, wherein the diffusing element is injected molded.

Item 28. The mixing assembly according to any one of items 4-27, wherein the diffusing element is a monolithic piece.

Item 29. The mixing assembly according to any one of items 6-28, further comprising a valve element, the valve element extending at least partially around the diffusing element.

Item 30. The mixing assembly according to item 29, wherein the valve element comprises a plurality of gates, the gates at least partially aligned with the apertures.

Item 31. The mixing assembly according to item 30, wherein the valve element is adapted to permit fluid flow in a single radial direction.

Item 32. The mixing assembly according to any one of items 30-31, wherein the valve element is adapted to permit fluid flow in only a radial outward direction.

Item 33. The mixing assembly according to any one of items 30-32, wherein the valve element is adapted to inhibit fluid flow in a radial inward direction.

Item 34. The mixing assembly according to any one of items 29-33, wherein the valve element comprises a flexible material.

Item 35. The mixing assembly according to any one of items 29-34, wherein the gates have a greater flexibility than the reminder of the valve element.

Item 36. The mixing assembly according to any one of items 29-35, wherein the valve element has a greater flexibility than the diffusing element.

Item 37. The mixing assembly according to any one of items 29-36, wherein the valve element comprises a polymer, a thermoplastic material, an elastomer, a silicone based material, or combinations thereof.

Item 38. The mixing assembly according to any one of items 29-37, wherein the valve element has an average radial thickness, $T_V$, wherein the diffusing element has a radial thickness, $T_D$, and wherein $T_D$ is greater than $T_V$.

Item 39. The mixing assembly according to any one of items 4-38, wherein the diffusing element further comprises a second valve element.

Item 40. The mixing assembly according to item 39, wherein the second valve element is substantially annular.

Item 41. The mixing assembly according to any one of items 39-40, wherein the second valve element is a monolithic piece.

Item 42. The mixing assembly according to any one of items 39-41, wherein the second valve element is engaged with the diffusing element proximate an outer circumference of the diffusing element.

Item 43. The mixing assembly according to any one of items 39-42, wherein the second valve element is engaged with the fluid agitating element.

Item 44. The mixing assembly according to any one of items 39-43, wherein the second valve element has a plurality of gates, wherein the gates are adapted to permit fluid flow in a single direction.

Item 45. The mixing assembly according to item 44, wherein the second valve element is adapted to permit fluid flow in a radial inward direction.

Item 46. The mixing assembly according to any one of items 29-45, wherein the valve element comprises a flexible material.

Item 47. The mixing assembly according to any one of items 29-46, wherein the gates have a greater flexibility than the reminder of the valve element.

Item 48. The mixing assembly according to any one of items 29-47, wherein the valve element has a greater flexibility than the diffusing element.

Item 49. The mixing assembly according to any one of items 37-48, wherein the second valve element comprises a silicone based material.

Item 50. The mixing assembly according to any one of the preceding items, wherein the fluid agitating element comprises a generally circular plate when viewed from the top, having an average diameter, $D_{FAE}$.

Item 51. The mixing assembly according to any one of the preceding items, wherein the fluid agitating element is radially tapered.

Item 52. The mixing assembly according to any one of the preceding items, wherein the fluid agitating element comprises a first surface and a second surface, and wherein the first and second surfaces are radially tapered.

Item 53. The mixing assembly according to any one of the preceding items, wherein the fluid agitating element comprises a cavity defining a volume.

Item 54. The mixing assembly according to item 53, wherein the magnetic member is disposed at least partially within the volume.

Item 55. The mixing assembly according to any one of the preceding items, wherein the magnetic member is hermetically sealed within the fluid agitating element.

Item 56. The mixing assembly according to any one of the preceding items, wherein the magnetic member is overmolded into the fluid agitating element.

Item 57. The mixing assembly according to any one of the preceding items, further comprising a support, wherein the fluid agitating element is coupled to the support, and wherein the fluid agitating element is adapted to translate along the support.

Item 58. The mixing assembly according to item 57, further comprising a fluid pump bearing adapted to provide a fluid layer between the support and the fluid agitating element, the fluid pump bearing defined by an annular cavity formed between the support and fluid agitating element.

Item 59. The mixing assembly according to any one of items 57-68, wherein the support includes a plurality of flutes.

Item 60. The mixing assembly of item 59, wherein the flutes are oriented at an angle $A_{CF}$, as defined by the angle between the flutes and the central axis of the support, and wherein $A_{CF}$ is at least 2 degrees, at least 3 degrees, at least 4 degrees, at least 5 degrees, at least 10 degrees, at least 15 degrees, or even at least 20 degrees.

Item 61. The mixing assembly according to any one of items 57-60, further comprising a plug, wherein the plug is adapted to engage proximate a distal end of the support.

Item 62. The mixing assembly according to any one of the preceding items, wherein the fluid agitating element comprises a polymer.

Item 63. The mixing assembly according to any one of the preceding items, wherein the mixing assembly has a buoyancy, wherein a fluid to be mixed has a buoyancy, and wherein the buoyancy of the mixing assembly is less than the buoyancy of the fluid.

Item 64. The mixing assembly according to any one of the preceding items, wherein the fluid agitating element is adapted to periodically reciprocate between a first position and a second position.

Item 65. The mixing assembly according to item 64, wherein the fluid agitating element is adapted to translate in a reciprocating manner through a stroke length, S, as measured between the first and second positions.

Item 66. The mixing assembly according to item 65, wherein the fluid agitating element has an average diameter, $D_{FAE}$, and wherein S is no less than 0.1 $D_{FAE}$, no less than 0.2 $D_{FAE}$, no less than 0.3 $D_{FAE}$, no less than 0.4 $D_{FAE}$, no less than 0.5 $D_{FAE}$, no less than 0.6 $D_{FAE}$, no less than 0.7 $D_{FAE}$, no less than 0.8 $D_{FAE}$, no less than 0.9 $D_{FAE}$, no less than 1.0 $D_{FAE}$, no less than 1.5 $D_{FAE}$.

Item 67. The mixing assembly according to any one of items 65-66, wherein S is no greater than 5.0 $D_{FAE}$, no greater than 4.5 $D_{FAE}$, no greater than 4.0 $D_{FAE}$, no greater than 3.5 $D_{FAE}$, no greater than 3.0 $D_{FAE}$, no greater than 2.5 $D_{FAE}$, no greater than 2.0 $D_{FAE}$, no greater than 1.5 $D_{FAE}$.

Item 68. The mixing assembly according to any one of items 65-67, wherein the fluid agitating element reciprocates at no less than 3 strokes per minute (SPM), no less than 5 SPM, no less than 10 SPM, no less than 20 SPM, no less than 30 SPM, no less than 40 SPM, no less than 50 SPM, no less than 75 SPM, no less than 100 SPM, no less than 150 SPM, no less than 200 SPM.

Item 69. The mixing assembly according to any one of items 1, 2, 4-68, wherein the magnetic member is adapted to magnetically couple to a drive device.

Item 70. The mixing assembly according to any one of the preceding items, wherein the magnetic member comprises a ferromagnetic material.

Item 71. The mixing assembly according to any one of the preceding items, wherein the magnetic member comprises a ferromagnetic material selected from the group consisting of steel, iron, cobalt, nickel, and earth magnets.

Item 72. The mixing assembly according to any one of the preceding items, wherein the drive device comprises a rotating driving magnet.

Item 73. The mixing assembly according to item 72, wherein the rotating driving magnet is bipolar.

Item 74. The mixing assembly according to any one of items 72-73, wherein the mixing assembly has a central axis, wherein the drive device has a central axis, and wherein the central axis of the mixing assembly is adapted to misalign with the central axis of the drive device.

Item 75. The mixing assembly according to any one of items 3 or 72-74, wherein the drive device comprises an electromagnetic element.

Item 76. The mixing assembly according to item 75, wherein the electromagnetic element is adapted to intermittently attract and repel the magnetic member.

Item 77. The mixing assembly according to any one of items 3, 69-76, wherein the mixing assembly is adapted such that a pumping action is generated in a fluid upon the magnetic member being attracted to the drive device.

Item 78. The mixing assembly according to item 77, wherein the mixing assembly is adapted to generate a fluidic pressure gradient within the fluid, characterized in that the fluid adjacent to a first face of the fluid agitating element has a higher pressure than the fluid adjacent to a second face of the fluid agitating element.

Item 79. The mixing assembly according to item 78, wherein increased fluidic pressure causes a turbulent fluidic net flow.

Item 80. The mixing assembly according to any one of the preceding items, wherein the mixing assembly is adapted to engage with a wall of a vessel.

Item 81. The mixing assembly according to any one of items 4-80, wherein the diffusing element is adapted to engage with a wall of a vessel.

Item 82. The mixing assembly according to any one of items 80-81, wherein the vessel comprises a flexible liner adapted to contain a fluid.

Item 83. The mixing assembly according to any one of items 80-82, wherein the vessel comprises a rigid container.

Item 84. The mixing assembly according to any one of items 80-83, wherein the mixing assembly is adapted to engage with a bottom wall of the vessel.

Item 85. The mixing assembly according to any one of the preceding items, wherein the mixing assembly is adapted to pump a fluid.

Item 86. The mixing assembly according to any one of the preceding items, wherein the mixing assembly is adapted to pump a fluid through an aperture.

Item 87. The mixing assembly according to any one of the preceding items, wherein the mixing assembly is adapted to generate turbulence within a fluid.

Item 88. The mixing assembly according to any one of the preceding items, wherein the fluid agitating element is adapted to reciprocate in a fluid, and wherein the fluid agitating element is adapted to generate a flow of the fluid within a vessel.

Item 89. The mixing assembly according to any one of the preceding items, wherein the mixing assembly is adapted to reciprocate within a vessel, and wherein the fluid agitating element is adapted to create a net circular flow of a fluid within a vessel.

Item 90. The mixing assembly according to any one of the preceding items, wherein adjustment of the relative movement of the fluid agitating element is determinative of a quantity of vortex rings generated in the fluid.

Item 91. The mixing assembly according to any one of the preceding items, wherein adjustment of the relative movement of the fluid agitating element is determinative of rate of generation of a quantity of vortex rings generated in the fluid.

Item 92. The mixing assembly according to any one of items 90-91, wherein adjustment of the relative movement of the fluid agitating element is determinative of a size of the vortex rings generated in the fluid.

Item 93. The mixing assembly according to any one of the preceding items, wherein the fluid agitating element further comprises at least one aperture.

Item 94. The mixing assembly according to item 93, wherein the fluid agitating element has a total surface area, $SA_{FAE}$, wherein the at least one aperture forms a total cutout area, $CA_A$, within the fluid agitating element, and wherein a ratio of $SA_{FAE}$:$CA_A$ is at least 1.01, at least 1.5, at least 2.0, at least 2.5, at least 3.0, at least 3.5, at least 4.0, at least 5.0, at least 10.0, at least 20.0.

Item 95. The mixing assembly according to item 94, wherein the ratio of $SA_{FAE}$:$CA_A$ is no greater than 1000, no greater than 900, no greater than 800, no greater than 700, no greater than 600, no greater than 500, no greater than 400, no greater than 300, no greater than 200, no greater than 100, no greater than 50, no greater than 25, no greater than 10.

Item 96. The mixing assembly according to any one of items 93-95, wherein the fluid agitating element further comprises a third valve element.

Item 97. The mixing assembly according to item 96, wherein the third valve element is substantially annular.

Item 98. The mixing assembly according to any one of items 96-97, wherein the third valve element is a monolithic piece.

Item 99. The mixing assembly according to any one of items 96-98, wherein the third valve element is engaged with the fluid agitating element.

Item 100. The mixing assembly according to any one of items 96-99, wherein the third valve element substantially covers the at least one aperture in the fluid agitating element, and wherein the third valve element is adapted to prevent fluid flow through the at least one aperture.

Item 101. The mixing assembly according to item 100, wherein the third valve element is adapted to prevent fluid flow through the at least one aperture in a direction away from the diffusing element.

Item 102. The mixing assembly according to any one of items 96-101, wherein the third valve element has a greater flexibility than the fluid agitating element.

Item 103. The mixing assembly according to any one of items 96-102, wherein the third valve element comprises a silicone based material.

Item 104. The mixing assembly according to any one of items 4-103, wherein a mixing cavity is defined by a volume located between the diffusing element and the fluid agitating element.

Item 105. The mixing assembly according to item 104, wherein the fluid agitating element is adapted to permit a fluid to pass therethrough and into the mixing cavity.

Item 106. The mixing assembly according to any one of items 104-105, wherein the fluid agitating element is adapted to permit a fluid to enter the mixing cavity.

Item 107. The mixing assembly according to any one of items 104-106, wherein the fluid agitating element is adapted to permit fluidic flow into the mixing cavity.

Item 108. The mixing assembly according to any one of items 104-107, wherein the fluid agitating element is adapted to permit increased fluidic flow into the mixing cavity.

What is claimed is:

1. A mixing assembly, comprising:

a fluid agitating element;

a magnetic member engaged with the fluid agitating element; and a diffusing element comprising a sidewall having a thickness defined by opposing surfaces and a plurality of apertures positioned along the sidewall and extending through the thickness, wherein the mixing assembly further comprises a valve element, the valve element extending at least partially around the diffusing element, wherein the valve element comprises a plurality of gates, the gates at least partially aligned with the apertures, and wherein the valve element is adapted to permit fluid flow in a single radial direction.

2. The mixing assembly according to claim 1, further comprising a support, wherein the fluid agitating element is coupled to the support, and wherein the fluid agitating element is adapted to translate along the support.

3. The mixing assembly according to claim 1, wherein the magnetic member is adapted to magnetically couple to a drive device, wherein the mixing assembly has a central axis, wherein the drive device has a central axis, and wherein the central axis of the mixing assembly is adapted to misalign with the central axis of the drive device.

4. The mixing assembly according to claim 1, wherein the mixing assembly is adapted to generate a plurality of vortex rings within a fluid in response to a linear oscillation of the magnetic member.

5. The mixing assembly according to claim 1, wherein the diffusing element comprises a radial flange extending radially inwardly from the sidewall.

6. The mixing assembly according to claim 1, wherein the fluid agitating element is radially tapered.

7. The mixing assembly according to claim 1, wherein the magnetic member is hermetically sealed within the fluid agitating element.

8. The mixing assembly according to claim 1, further comprising a support, wherein the fluid agitating element is coupled to the support, and wherein the fluid agitating element is adapted to translate along the support.

9. The mixing assembly according to claim 1, wherein the mixing assembly has a buoyancy, wherein a fluid to be mixed has a buoyancy, and wherein the buoyancy of the mixing assembly is less than the buoyancy of the fluid.

10. The mixing assembly according to claim 1, wherein the magnetic member is adapted to magnetically couple to a drive device, and wherein the drive device comprises a rotating driving magnet.

11. The mixing assembly according to claim 10, wherein the mixing assembly has a central axis, wherein the drive device has a central axis, and wherein the central axis of the mixing assembly is adapted to misalign with the central axis of the drive device.

12. The mixing assembly of claim 1, wherein the mixing assembly further comprises a rigid vessel, and wherein a flexible vessel is adapted to be disposed within the rigid vessel.

13. The mixing assembly according to claim 1, wherein the plurality of apertures have substantially the same size.

14. The mixing assembly of claim 1, wherein the plurality of apertures have substantially the same shape.

15. The mixing assembly according to claim 1, wherein the diffusing element has an inner surface area, $A_{DE}$, wherein the apertures define an area, $A_P$, and wherein $A_{DE}$ is at least 1.1 $A_P$.

16. The mixing assembly according to claim 15, wherein $A_{DE}$ is no greater than 10 $A_P$.

* * * * *